US011950625B2

(12) United States Patent
Mironov et al.

(10) Patent No.: US 11,950,625 B2
(45) Date of Patent: Apr. 9, 2024

(54) SMOKING ARTICLE COMPRISING AN ISOLATED COMBUSTIBLE HEAT SOURCE

(71) Applicant: Philip Morris Products S.A., Neuchatel (CH)

(72) Inventors: Oleg Mironov, Neuchatel (CH); Laurent Edouard Poget, Bussigny (CH)

(73) Assignee: Philip Morris Products S.A., Neuchatel (CH)

( * ) Notice: Subject to any disclaimer, the term of this patent is extended or adjusted under 35 U.S.C. 154(b) by 96 days.

(21) Appl. No.: 17/453,269

(22) Filed: Nov. 2, 2021

(65) Prior Publication Data

US 2022/0125100 A1 Apr. 28, 2022

Related U.S. Application Data

(63) Continuation of application No. 14/377,433, filed as application No. PCT/EP2013/052794 on Feb. 12, 2013, now Pat. No. 11,191,299.

(30) Foreign Application Priority Data

Feb. 13, 2012 (EP) ..... 12155239

(51) Int. Cl.
*A24F 47/00* (2020.01)
*A24D 1/22* (2020.01)

(52) U.S. Cl.
CPC ..... *A24D 1/22* (2020.01)

(58) Field of Classification Search
CPC ..... A24D 1/22
See application file for complete search history.

(56) References Cited

U.S. PATENT DOCUMENTS 3,258,015 A 6/1966 Ellis et al.
3,515,146 A 6/1970 Nealis
(Continued)

FOREIGN PATENT DOCUMENTS

CN 87 1 05964 A 6/1988
CN 88 1 00383 A 8/1988
(Continued)

OTHER PUBLICATIONS

Office Action dated Aug. 6, 2021 in Chinese Application No. 201810915963.2, along with an English translation.
(Continued)

*Primary Examiner* — Eric Yaary
(74) *Attorney, Agent, or Firm* — Oblon, McClelland, Maier & Neustadt, L.L.P.

(57) ABSTRACT

A smoking article is provided, including: a combustible heat source having front and rear ends; an aerosol-forming substrate downstream of the rear end; an outer wrapper circumscribing the substrate and at least a rear portion of the heat source; one or more airflow pathways along which air may be drawn through the article for inhalation; one or more third air inlets downstream of the substrate for drawing air into the airflow pathways; and an airflow directing element downstream of the substrate, the third air inlets being provided between a downstream end of the substrate and a downstream end of the airflow directing element, the airflow pathways include an airflow pathway extending between the third air inlets and a mouth end of the article, and the heat source being isolated from the pathways such that air drawn through the article along the pathways does not directly contact the heat source.

21 Claims, 2 Drawing Sheets

(56) References Cited

U.S. PATENT DOCUMENTS

| | | | | |
|---|---|---|---|---|
| 4,340,072 | A | 7/1982 | Bolt et al. | |
| 4,714,082 | A | 12/1987 | Banerjee et al. | |
| 4,771,795 | A | 9/1988 | White | |
| 4,819,665 | A | 4/1989 | Roberts | |
| 4,848,374 | A | 7/1989 | Chard | |
| 5,040,551 | A | 8/1991 | Schlatter et al. | |
| 5,060,667 | A | 10/1991 | Strubel | |
| 5,076,292 | A | 12/1991 | Sensabaugh, Jr. et al. | |
| 5,105,831 | A | 4/1992 | Banerjee et al. | |
| 5,392,792 | A | 2/1995 | Banerjee et al. | |
| 6,095,152 | A * | 8/2000 | Beven | A24D 1/22 131/365 |
| 6,164,287 | A | 12/2000 | White | |
| 2003/0075188 | A1 | 4/2003 | Adiga et al. | |
| 2007/0215167 | A1 | 9/2007 | Llewellyn Crooks | |
| 2008/0149118 | A1 | 6/2008 | Oqlesbv | |
| 2009/0065011 | A1 | 3/2009 | Maeder | |
| 2010/0059070 | A1 | 3/2010 | Potter | |
| 2010/0083959 | A1 | 4/2010 | Siller | |
| 2011/0041861 | A1 | 2/2011 | Sebastian et al. | |
| 2011/0073121 | A1 | 3/2011 | Levin et al. | |
| 2012/0067360 | A1 * | 3/2012 | Conner | A24D 1/22 131/194 |

FOREIGN PATENT DOCUMENTS

| | | | |
|---|---|---|---|
| CN | 1039711 | A | 2/1990 |
| CN | 1290131 | A | 4/2001 |
| CN | 1607911 | A | 4/2005 |
| CN | 1328992 | C | 8/2007 |
| CN | 101267749 | A | 9/2008 |
| CN | 101500443 | A | 8/2009 |
| CN | 101778578 | A | 7/2010 |
| CN | 102159100 | A | 8/2011 |
| CN | 103874432 | A | 6/2014 |
| CN | 104105419 | A | 10/2014 |
| CN | 109222237 | A | 1/2019 |
| CN | 109222238 | A | 1/2019 |
| DE | 198 54 008 | | 5/2000 |
| DE | 198 54 008 | C2 | 4/2001 |
| DE | 10 2007 026 979 | | 4/2008 |
| EP | 0 212 234 | A2 | 3/1987 |
| EP | 0 337 507 | A2 | 10/1989 |
| EP | 0 352 108 | A2 | 1/1990 |
| JP | 56-131379 | A | 10/1981 |
| JP | S62-48370 | A | 3/1987 |
| JP | 63-192372 | A | 8/1988 |
| JP | 3-19684 | A | 1/1991 |
| JP | 3-90163 | A | 4/1991 |
| JP | H03-90161 | | 4/1991 |
| JP | 3-232481 | A | 10/1991 |
| JP | 2001-507576 | A | 6/2001 |
| JP | 2009-529871 | A | 8/2009 |
| JP | 2010-535530 | A | 11/2010 |
| RU | 2097996 | C1 | 12/1997 |
| RU | 2120781 | C1 | 10/1998 |
| TW | 201023769 | A | 7/2010 |
| WO | 03 034847 | | 5/2003 |
| WO | WO 2009/022232 | A2 | 2/2009 |
| WO | WO 2009/074870 | A2 | 6/2009 |
| WO | WO 2009/084458 | A1 | 7/2009 |
| WO | WO 2011/117750 | A2 | 9/2011 |
| WO | 2012 016795 | | 2/2012 |
| WO | WO 2012/014490 | A1 | 2/2012 |

OTHER PUBLICATIONS

Japanese Office Action dated Dec. 2, 2019 in Japanese Patent Application No. 2017-213661 with English translation.

Korean Office Action dated Aug. 21, 2019, in Patent Application No. 10-2019-7022218, 12 pages (with English translation).

Office Action dated Dec. 17, 2018 in Japanese Patent Application No. 2017-213661 with English Translation.

Preappeal Review Report issued Dec. 26, 2017 in Japanese Patent Application No. 2014-556100 (with English language translation) 4 pages.

Office Action dated Sep. 28, 2020 in corresponding Chinese Application No. 201810914516.5, along with an English translation.

Office Action dated Sep. 30, 2020 in corresponding Chinese Application No. 201810915964.7, along with an English translation.

Office Action dated Oct. 10, 2020 in corresponding Chinese Application No. 201810915963.2, along with an English translation.

"Various Measurement Methods in a Wide Temperature Range Comparison of Thermal Conductivity of Thermal Insulation Technical Times" Nichias Technical No. 3, No. 351, 2007, pp. 1-10 (with English translation).

Japanese Office Action dated Jan. 12, 2017 in Patent Application No. 2014-556100 (with English translation).

Chinese Office Action and Search Report with English translation dated Dec. 26, 2016 in the corresponding Chinese Patent Application No. 201380008557.3, (17 pages).

Combined Chinese Office Action and Search Report dated Mar. 25, 2016 in Patent Application No. 201380008557.3 (with English language translation).

Combined Taiwanese Office Action and Search Report dated Oct. 6, 2016 in Patent Application No. 102105233 (with English translation).

International Search Report dated May 24, 2013 in PCT/EP13/052794 Filed Feb. 12, 2013.

Office Action and Search Report issued Nov. 16, 2023 in corresponding Russian Patent Application No. 2020125870, and an English translation.

* cited by examiner

SMOKING ARTICLE COMPRISING AN ISOLATED COMBUSTIBLE HEAT SOURCE

CROSS-REFERENCE TO RELATED APPLICATIONS

This application is a continuation application of and claims benefit under 35 U.S.C. § 120 to U.S. application Ser. No. 14/377,433, filed on Aug. 7, 2014, which is a U.S. national stage application of PCT/EP2013/052794, filed on Feb. 12, 2013, which claims the benefit of priority under 35 U.S.C. § 119 to European Application No. 12155239.2, filed on Feb. 13, 2012, the entire contents of each of which are incorporated herein by reference.

TECHNICAL FIELD

The present invention relates to a smoking article comprising a combustible heat source and an aerosol-forming substrate downstream of the combustible heat source.

DESCRIPTION OF THE RELATED ART

A number of smoking articles in which tobacco is heated rather than combusted have been proposed in the art. One aim of such 'heated' smoking articles' is to reduce known harmful smoke constituents of the type produced by the combustion and pyrolytic degradation of tobacco in conventional cigarettes. In one known type of heated smoking article, an aerosol is generated by the transfer of heat from a combustible heat source to an aerosol-forming substrate. The aerosol-forming substrate may be located within, around or downstream of the combustible heat source. During smoking, volatile compounds are released from the aerosol-forming substrate by heat transfer from the combustible heat source and entrained in air drawn through the smoking article. As the released compounds cool, they condense to form an aerosol that is inhaled by the user. Typically, air is drawn into such known heated smoking articles through one or more airflow channels provided through the combustible heat source and heat transfer from the combustible heat source to the aerosol-forming substrate occurs by convection and conduction.

For example, WO-A2-2009/022232 discloses a smoking article comprising a combustible heat source, an aerosol-forming substrate downstream of the combustible heat source, and a heat-conducting element around and in direct contact with a rear portion of the combustible heat source and an adjacent front portion of the aerosol-forming substrate. To provide a controlled amount of convective heating of the aerosol-forming substrate, at least one longitudinal airflow channel is provided through the combustible heat source. In the smoking article of WO-A2-2009/022232, the surface of the aerosol-forming substrate abuts the combustible heat source and, in use, air drawn through the smoking article comes into direct contact with the rear end surface of the combustible heat source.

In known heated smoking articles in which heat transfer from the combustible heat source to the aerosol-forming substrate occurs primarily by convection, the convective heat transfer and hence the temperature in the aerosol-forming substrate can vary considerably depending upon the puffing behaviour of the user. As a result, the composition and hence the sensory properties of the mainstream aerosol inhaled by the user may be disadvantageously highly sensitive to a user's puffing regime.

In known heated smoking articles in which air drawn through the heated smoking article comes into direct contact with the combustible heat source of the heated smoking article, puffing by a user results in activation of combustion of the combustible heat source. Intense puffing regimes may therefore lead to sufficiently high convective heat transfer to cause spikes in the temperature of the aerosol-forming substrate, disadvantageously leading to pyrolysis and potentially even localised combustion of the aerosol-forming substrate. As used herein, the term 'spike' is used to describe a short-lived increase in the temperature of the aerosol-forming substrate.

The levels of undesirable pyrolytic and combustion by-products in the mainstream aerosols generated by such known heated smoking articles may also disadvantageously vary significantly depending upon the particular puffing regime adopted by the user.

It is known to include additives in the combustible heat sources of heated smoking articles in order to improve the ignition and combustion properties of the combustible heat sources. However, the inclusion of ignition and combustion additives can give rise to decomposition and reaction products, which disadvantageously enter air drawn through the aerosol-forming substrates of the heated smoking articles during use thereof.

A number of previous attempts have been made to reduce or eliminate undesirable smoke constituents from the air drawn through the aerosol-forming substrates of heated smoking articles with a combustible heat source during use thereof. For example, a number of previous attempts have been made to reduce the amount of carbon monoxide produced during combustion of carbonaceous heat sources for heated smoking articles by using catalysts in the carbonaceous heat source to convert carbon monoxide produced during combustion of the carbonaceous heat source into carbon dioxide.

U.S. Pat. No. 5,040,551 discloses a method for reducing the amount of carbon monoxide produced during combustion of a carbonaceous fuel element for a heated smoking article comprising an aerosol generating means. The method comprises coating some or all of the exposed surfaces of the carbonaceous fuel element with a thin, microporous layer of solid particulate matter, which is substantially non-combustible at temperatures in which the carbonaceous fuel element combusts. The coating may additionally include catalytic ingredients. According to U.S. Pat. No. 5,040,551, the microporous layer must be sufficiently thin, and therefore permeable to air, so as not to unduly prevent the carbonaceous fuel from combusting. Consequently, air drawn through the smoking article of U.S. Pat. No. 5,040,551 comes into direct contact with the surface of the carbonaceous fuel element, leading to increased levels of undesirable smoke constituents.

U.S. Pat. No. 5,060,667 discloses a smoking article comprising a combustible fuel element, a hollow heat transfer tube circumscribing the fuel element, a flavor source material circumscribing the heat transfer tube, and a porous wrapper circumscribing the smoking article. The heat transfer tube is open at its upstream end and closed at its downstream end and has an annular flange at its upstream end having an outside diameter substantially the same as that of the smoking article and a centrally disposed opening in alignment with the combustible end element. The closed downstream end of the heat transfer tube and the annular flange at the upstream end of the heat transfer tube prevent smoke from the fuel element from entering the smokers mouth To facilitate aerosol formation, the aerosol-forming substrates of heated smoking articles typically comprise a polyhydric alcohol, such as glycerine, or other known aerosol-formers. During storage and smoking, such aerosol-formers may migrate from the aerosol-forming substrates of known heated smoking articles to the combustible heat sources thereof. Migration of aerosol-formers to the combustible heat sources of known heated smoking articles can disadvantageously lead to decomposition of the aerosol-formers, particularly during smoking of the heated smoking articles.

A number of previous attempts have been made to inhibit migration of aerosol-formers from the aerosol-forming substrates of heated smoking articles to the combustible heat sources thereof. Generally, such previous attempts have involved enveloping the aerosol-forming substrate of a heated smoking article within a non-combustible capsule, such as a metallic cage, to reduce migration of aerosol-formers from the aerosol-forming substrate to the combustible heat source during storage and use. However, the combustible heat source is still allowed to come into direct contact with aerosol-formers from the aerosol-forming substrate during storage and use and air drawn through the aerosol-forming substrate for inhalation by a user may still come into direct contact with the surface of the combustible heat source. This disadvantageously allows decomposition and combustion gases generated from the combustible heat source to be drawn into the mainstream aerosol of such known heated smoking articles.

There remains a need for a heated smoking article comprising a combustible heat source with opposed front and rear faces and an aerosol-forming substrate downstream of the rear face of the combustible heat source in which spikes in the temperature of the aerosol-forming substrate are avoided under intense puffing regimes. In particular, there remains a need for a heated smoking article comprising a combustible heat source with opposed front and rear faces and an aerosol-forming substrate downstream of the rear face of the combustible heat source in which substantially no combustion or pyrolysis of the aerosol-forming substrate occurs under intense puffing regimes.

There further remains a need for a heated smoking article comprising a combustible heat source with opposed front and rear faces and an aerosol-forming substrate downstream of the rear face of the combustible heat source in which combustion and decomposition products formed during ignition and combustion of the combustible heat source are prevented or inhibited from entering air drawn through the aerosol-forming substrate during use of the heated smoking article.

There also further remains a need for a heated smoking article comprising a combustible heat source with opposed front and rear faces and an aerosol-forming substrate downstream of the rear face of the combustible heat source in which migration of aerosol-former from the aerosol-forming substrate to the combustible heat source is substantially prevented or inhibited.

SUMMARY

According to the invention, there is provided a smoking article comprising: a combustible heat source with opposed front and rear faces; an aerosol-forming substrate downstream of the rear face of the combustible heat source; an outer wrapper circumscribing the aerosol-forming substrate and at least a rear portion of the combustible heat source; and one or more airflow pathways along which air may be drawn through the smoking article for inhalation by a user. The combustible heat source is isolated from the one or more airflow pathways such that, in use, air drawn through the smoking article along the one or more airflow pathways does not directly contact the combustible heat source.

According to the invention there is also provided a combustible heat source with opposed front and rear faces for use in a smoking article according to the invention, wherein the combustible heat source has a non-combustible, substantially air impermeable first barrier provided on at least substantially the entire rear face of the combustible heat source. In certain preferred embodiments, the first barrier comprises a first barrier coating provided on the rear face of the combustible heat source. In such embodiments, preferably the first barrier comprises a first barrier coating provided on at least substantially the entire rear face of the combustible heat source. More preferably, the first barrier comprises a first barrier coating provided on the entire rear face of the combustible heat source.

According to the invention there is further provided a method of reducing or eliminating increases in temperature of an aerosol-forming substrate of a smoking article during puffing. The method comprises providing a smoking article comprising: a combustible heat source with opposed front and rear faces; an aerosol-forming substrate downstream of the rear face of the combustible heat source; an outer wrapper circumscribing the aerosol-forming substrate and at least a rear portion of the combustible heat source; and one or more airflow pathways along which air may be drawn through the smoking article for inhalation by a user, wherein the combustible heat source is isolated from the one or more airflow pathways such that, in use, air drawn through the smoking article along the one or more airflow pathways does not directly contact the combustible heat source.

BRIEF DESCRIPTION OF THE DRAWINGS

The invention will be further described, by way of example only, with reference to the accompanying drawings in which.

DETAILED DESCRIPTION

Figure 1A:
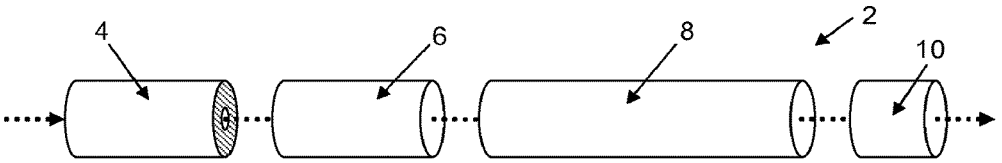
FIG. 1A shows an exploded view of a smoking article according to a first embodiment of the invention comprising a non-blind combustible heat source.

As used herein, the term 'airflow pathway' is used to describe a route along which air may be drawn through the smoking article for inhalation by a user.

As used herein, the term 'aerosol-forming substrate' is used to describe a substrate capable of releasing upon heating volatile compounds, which can form an aerosol. The aerosols generated from aerosol-forming substrates of smoking articles according to the invention may be visible or invisible and may include vapours (for example, fine particles of substances, which are in a gaseous state, that are ordinarily liquid or solid at room temperature) as well as gases and liquid droplets of condensed vapours.

As used herein, the terms 'upstream' and 'front', and 'downstream' and 'rear', are used to describe the relative positions of components, or portions of components, of the smoking article in relation to the direction in which a user draws on the smoking article during use thereof. Smoking articles according to the invention comprise a mouth end and an opposed distal end. In use, a user draws on the mouth end of the smoking article. The mouth end is downstream of the distal end. The combustible heat source is located at or proximate to the distal end.

The front face of the combustible heat source is at the upstream end of the combustible heat source. The upstream end of the combustible heat source is the end of the combustible heat source furthest from the mouth end of the smoking article. The rear face of the combustible heat source is at the downstream end of the combustible heat source. The downstream end of the combustible heat source is the end of the combustible heat source closest to the mouth end of the smoking article.

As used herein, the term 'length' is used to describe the dimension in the longitudinal direction of the smoking article.

As used herein, the term 'direct contact' is used to describe contact between air drawn through the smoking article along the one or more airflow pathways and a surface of the combustible heat source.

As used herein, the term 'isolated combustible heat source' is used to describe a combustible heat source that does not come into direct contact with air drawn through the smoking article along the one or more airflow pathways.

As used herein, the term 'coating' is used to describe a layer of material that covers and is adhered to the combustible heat source.

As described further below, smoking articles according to the invention may comprise combustible heat sources that are blind or non-blind.

As used herein, the term 'blind' is used to describe a combustible heat source of a smoking article according to the invention in which air drawn through the smoking article for inhalation by a user does not pass through any airflow channels along the combustible heat source.

As used herein, the term 'non-blind' is used to describe a combustible heat source of a smoking article according to the invention in which air drawn through the smoking article for inhalation by a user passes through one or more airflow channels along the combustible heat source.

As used herein, the term 'airflow channel' is used to describe a channel extending along the length of a combustible heat source through which air may be drawn downstream for inhalation by a user.

Isolation of the combustible heat source from the one or more airflow pathways in accordance with the invention advantageously substantially prevents or inhibits activation of combustion of the combustible heat source of smoking articles according to the invention during puffing by a user. This substantially prevents or inhibits spikes in the temperature of the aerosol-forming substrate during puffing by a user.

By preventing or inhibiting activation of combustion of the combustible heat source, and so preventing or inhibiting excess temperature increases in the aerosol-forming substrate, combustion or pyrolysis of the aerosol-forming substrate of smoking articles according to the invention under intense puffing regimes may be advantageously avoided. In addition, the impact of a user's puffing regime on the composition of the mainstream aerosol of smoking articles according to the invention may be advantageously minimised or reduced.

Isolation of the combustible heat source from the one or more airflow pathways also advantageously substantially prevents or inhibits combustion and decomposition products and other materials formed during ignition and combustion of the combustible heat source of smoking articles according to the invention from entering air drawn through the smoking articles along the one or more airflow pathways. As described further below, this is particularly advantageous where the combustible heat source comprises one or more additives to aid ignition or combustion of the combustible heat source.

Isolation of the combustible heat source from the one or more airflow pathways isolates the combustible heat source from the aerosol-forming substrate. Isolation of the combustible heat source from the aerosol-forming substrate may advantageously substantially prevent or inhibit migration of components of the aerosol-forming substrate of smoking articles according to the invention to the combustible heat source during storage of the smoking articles.

Alternatively or in addition, isolation of the combustible heat source from the one or more airflow pathways may advantageously substantially prevent or inhibit migration of components of the aerosol-forming substrate of smoking articles according to the invention to the combustible heat source during use of the smoking articles.

As described further below, isolation of the combustible heat source from the one or more airflow pathways and aerosol-forming substrate is particularly advantageous where the aerosol-forming substrate comprises at least one aerosol-former.

To isolate the combustible heat source from the one or more airflow pathways, smoking articles according to the invention may comprise a non-combustible, substantially air impermeable, first barrier between a downstream end of the combustible heat source and an upstream end of the aerosol-forming substrate.

As used herein, the term 'non-combustible' is used to describe a barrier that is substantially non-combustible at temperatures reached by the combustible heat source during combustion or ignition thereof.

The first barrier may abut one or both of the downstream end of the combustible heat source and the upstream end of the aerosol-forming substrate.

The first barrier may be adhered or otherwise affixed to one or both of the downstream end of the combustible heat source and the upstream end of the aerosol-forming substrate.

In some embodiments, the first barrier comprises a first barrier coating provided on the rear face of the combustible heat source. In such embodiments, preferably the first barrier comprises a first barrier coating provided on at least substantially the entire rear face of the combustible heat source. More preferably, the first barrier comprises a first barrier coating provided on the entire rear face of the combustible heat source.

The first barrier may advantageously limit the temperature to which the aerosol-forming substrate is exposed during ignition or combustion of the combustible heat source, and so help to avoid or reduce thermal degradation or combustion of the aerosol-forming substrate during use of the smoking article. As described further below, this is particularly advantageous where the combustible heat source comprises one or more additives to aid ignition of the combustible heat source.

Depending upon the desired characteristics and performance of the smoking article, the first barrier may have a low thermal conductivity or a high thermal conductivity. In certain embodiments, the first barrier may be formed from material having a bulk thermal conductivity of between about 0.1 W per metre Kelvin (W/(m·K)) and about 200 W per metre Kelvin (W/(m·K)), at 23° C. and a relative humidity of 50% as measured using the modified transient plane source (MTPS) method.

The thickness of the first barrier may be appropriately adjusted to achieve good smoking performance. In certain embodiments, the first barrier may have a thickness of between about 10 microns and about 500 microns.

The first barrier may be formed from one or more suitable materials that are substantially thermally stable and non-combustible at temperatures achieved by the combustible heat source during ignition and combustion. Suitable materials are known in the art and include, but are not limited to, clays (such as, for example, bentonite and kaolinite), glasses, minerals, ceramic materials, resins, metals and combinations thereof.

Preferred materials from which the first barrier may be formed include clays and glasses. More preferred materials from which the first barrier may be formed include copper, aluminium, stainless steel, alloys, alumina ($Al_2O_3$), resins, and mineral glues.

In one embodiment, the first barrier comprises a clay coating comprising a 50/50 mixture of bentonite and kaolinite provided on the rear face of the combustible heat source. In one more preferred embodiment, the first barrier comprises an aluminium coating provided on a rear face of the combustible heat source. In another preferred embodiment, the first barrier comprises a glass coating, more preferably a sintered glass coating, provided on a rear face of the combustible heat source.

Preferably, the first barrier has a thickness of at least about 10 microns. Due to the slight permeability of clays to air, in embodiments where the first barrier comprises a clay coating provided on the rear face of the combustible heat source, the clay coating more preferably has a thickness of at least about 50 microns, and most preferably of between about 50 microns and about 350 microns. In embodiments where the first barrier is formed from one or more materials that are more impervious to air, such as aluminium, the first barrier may be thinner, and generally will preferably have a thickness of less than about 100 microns, and more preferably of about 20 microns. In embodiments where the first barrier comprises a glass coating provided on the rear face of the combustible heat source, the glass coating preferably has a thickness of less than about 200 microns. The thickness of the first barrier may be measured using a microscope, a scanning electron microscope (SEM) or any other suitable measurement methods known in the art.

Where the first barrier comprises a first barrier coating provided on the rear face of the combustible heat source, the first barrier coating may be applied to cover and adhere to the rear face of the combustible heat source by any suitable methods known in the art including, but not limited to, spray-coating, vapour deposition, dipping, material transfer (for example, brushing or gluing), electrostatic deposition or any combination thereof.

For example, the first barrier coating may be made by pre-forming a barrier in the approximate size and shape of the rear face of the combustible heat source, and applying it to the rear face of the combustible heat source to cover and adhere to at least substantially the entire rear face of the combustible heat source. Alternatively, the first barrier coating may be cut or otherwise machined after it is applied to the rear face of the combustible heat source. In one preferred embodiment, aluminium foil is applied to the rear face of the combustible heat source by gluing or pressing it to the combustible heat source, and is cut or otherwise machined so that the aluminium foil covers and adheres to at least substantially the entire rear face of the combustible heat source, preferably to the entire rear face of the combustible heat source.

In another preferred embodiment, the first barrier coating is formed by applying a solution or suspension of one or more suitable coating materials to the rear face of the combustible heat source. For example, the first barrier coating may be applied to the rear face of the combustible heat source by dipping the rear face of the combustible heat source in a solution or suspension of one or more suitable coating materials or by brushing or spray-coating a solution or suspension or electrostatically depositing a powder or powder mixture of one or more suitable coating materials onto the rear face of the combustible heat source. Where the first barrier coating is applied to the rear face of the combustible heat source by electrostatically depositing a powder or powder mixture of one or more suitable coating materials onto the rear face of the combustible heat source, the rear face of the combustible heat source is preferably pre-treated with water glass before electrostatic deposition. Preferably, the first barrier coating is applied by spray-coating.

The first barrier coating may be formed through a single application of a solution or suspension of one or more suitable coating materials to the rear face of the combustible heat source. Alternatively, the first barrier coating may be formed through multiple applications of a solution or suspension of one or more suitable coating materials to the rear face of the combustible heat source. For example, the first barrier coating may be formed through one, two, three, four, five, six, seven or eight successive applications of a solution or suspension of one or more suitable coating materials to the rear face of the combustible heat source.

Preferably, the first barrier coating is formed through between one and ten applications of a solution or suspension of one or more suitable coating materials to the rear face of the combustible heat source.

After application of the solution or suspension of one or more coating materials to the rear face thereof, the combustible heat source may be dried to form the first barrier coating.

Where the first barrier coating is formed through multiple applications of a solution or suspension of one or more suitable coating materials to the rear face thereof, the combustible heat source may need to be dried between successive applications of the solution or suspension.

Alternatively or in addition to drying, after application of a solution or suspension of one or more coating materials to the rear face of the combustible heat source, the coating material on the combustible heat source may be sintered in order to form the first barrier coating. Sintering of the first barrier coating is particularly preferred where the first barrier coating is a glass or ceramic coating. Preferably, the first barrier coating is sintered at a temperature of between about 500° C. and about 900° C., and more preferably at about 700° C.

Smoking articles according to the invention comprise one or more airflow pathways along which air may be drawn through the smoking article.

In certain embodiments, the one or more airflow pathways of smoking articles according to the invention may comprise one or more airflow channels along the combustible heat source. The combustible heat sources of smoking articles according to such embodiments are referred to herein as non-blind combustible heat sources.

In smoking articles according to the invention comprising non-blind combustible heat sources, heating of the aerosol-forming substrate occurs by conduction and convection. In use, when a user puffs on a smoking article according to the invention comprising a non-blind heat source, air is drawn downstream through the one or more airflow channels along the combustible heat source. The drawn air then passes through the aerosol-forming substrate as it is drawn further downstream through the one or more airflow pathways of the smoking article for inhalation by the user.

The one or more airflow pathways of smoking articles according to the invention comprising a non-blind combustible heat source may comprise one or more enclosed airflow channels along the combustible heat source.

As used herein, the term 'enclosed' is used to describe airflow channels that are surrounded by the combustible heat source along their length.

For example, the one or more airflow pathways may comprise one or more enclosed airflow channels that extend through the interior of the combustible heat source along the entire length of the combustible heat source. In such embodiments the one or more airflow channels extend between the opposed front and rear faces of the combustible heat sources.

Alternatively or in addition, the one or more airflow pathways may comprise one or more non-enclosed airflow channels along the combustible heat source. For example, the one or more airflow pathways may comprise one or more grooves or other non-enclosed airflow channels that extend along the exterior of the combustible heat source along at least a downstream portion of the length of the combustible heat source.

The one or more airflow pathways may comprise one or more enclosed airflow channels along the combustible heat source or one or more non-enclosed airflow channels along the combustible heat source or a combination thereof.

In certain embodiments, the one or more airflow pathways may comprise one, two or three airflow channels. In one preferred embodiment, the one or more airflow pathways comprise a single airflow channel extending through the interior of the combustible heat source. In one particularly preferred embodiment, the one or more airflow pathways comprise a single substantially central or axial airflow channel extending through the interior of the combustible heat source. The diameter of the single airflow channel is preferably between about 1.5 mm and about 3 mm.

Where smoking articles according to the invention comprise a first barrier comprising a first barrier coating provided on the rear face of the combustible heat source and one or more airflow pathways comprising one or more airflow channels along the combustible heat source, the first barrier coating should allow air to be drawn downstream through the one or more airflow channels.

Where the one or more airflow pathways comprise one or more airflow channels along the combustible heat source, smoking articles according to the invention may further comprise a non-combustible, substantially air impermeable, second barrier between the combustible heat source and the one or more airflow channels to isolate the combustible heat source from the one or more airflow pathways.

In some embodiments, the second barrier may be adhered or otherwise affixed to the combustible heat source.

Preferably, the second barrier comprises a second barrier coating provided on an inner surface of the one or more airflow channels. More preferably, the second barrier comprises a second barrier coating provided on at least substantially the entire inner surface of the one or more airflow channels. Most preferably, the second barrier comprises a second barrier coating provided on the entire inner surface of the one or more airflow channels.

Alternatively, the second barrier coating may be provided by insertion of a liner into the one or more airflow channels. For example, where the one or more airflow pathways comprise one or more airflow channels that extend through the interior of the combustible heat source, a non-combustible, substantially air impermeable hollow tube may be inserted into each of the one or more airflow channels.

The second barrier may advantageously substantially prevent or inhibit combustion and decomposition products formed during ignition and combustion of the combustible heat source of smoking articles according to the invention from entering air drawn downstream along the one or more airflow channels.

The second barrier may also advantageously substantially prevent or inhibit activation of combustion of the combustible heat source of smoking articles according to the invention during puffing by a user.

Depending upon the desired characteristics and performance of the smoking article, the second barrier may have a low thermal conductivity or a high thermal conductivity. Preferably, the second barrier has a low thermal conductivity.

The thickness of the second barrier may be appropriately adjusted to achieve good smoking performance. In certain embodiments, the second barrier may have a thickness of between about 30 microns and about 200 microns. In a preferred embodiment, the second barrier has a thickness of between about 30 microns and about 100 microns.

The second barrier may be formed from one or more suitable materials that are substantially thermally stable and non-combustible at temperatures achieved by the combustible heat source during ignition and combustion. Suitable materials are known in the art and include, but are not limited to, for example: clays; metal oxides, such as iron oxide, alumina, titania, silica, silica-alumina, zirconia and ceria; zeolites; zirconium phosphate; and other ceramic materials or combinations thereof.

Preferred materials from which the second barrier may be formed include clays, glasses, aluminium, iron oxide and combinations thereof. If desired, catalytic ingredients, such as ingredients that promote the oxidation of carbon monoxide to carbon dioxide, may be incorporated in the second barrier. Suitable catalytic ingredients include, but are not limited to, for example, platinum, palladium, transition metals and their oxides.

Where smoking articles according to the invention comprise a first barrier between a downstream end of the combustible heat source and an upstream end of the aerosol-forming substrate and a second barrier between the combustible heat source and one or more airflow channels along the combustible heat source, the second barrier may be formed from the same or different material or materials as the first barrier.

Where the second barrier comprises a second barrier coating provided on an inner surface of the one or more airflow channels, the second barrier coating may be applied to the inner surface of the one or more airflow channels by any suitable method, such as the methods described in U.S. Pat. No. 5,040,551. For example, the inner surface of the one or more airflow channels may be sprayed, wetted or painted with a solution or a suspension of the second barrier coating. In a preferred embodiment, the second barrier coating is applied to the inner surface of the one or more airflow channels by the process described in WO-A2-2009/074870 as the combustible heat source is extruded.

In other embodiments, the one or more airflow pathways of smoking articles according to the invention may not comprise any airflow channels along the combustible heat source.

The combustible heat sources of smoking articles according to such embodiments are referred to herein as blind combustible heat sources.

In smoking articles according to the invention comprising blind combustible heat sources, heat transfer from the combustible heat source to the aerosol-forming substrate occurs primarily by conduction and heating of the aerosol-forming substrate by convection is minimised or reduced. This advantageously helps to minimise or reduce the impact of a user's puffing regime on the composition of the mainstream aerosol of smoking articles according to the invention comprising blind combustible heat sources.

It will be appreciated that smoking articles according to the invention may comprise blind combustible heat sources comprising one or more closed or blocked passageways through which air may not be drawn for inhalation by a user. Such closed passageways do not form part of the one or more airflow pathways of the smoking articles according to the invention. It will also be appreciated that, in addition to one or more airflow channels through which air may be drawn for inhalation by a user, non-blind combustible heat sources of smoking articles according to the invention may also comprise one or more closed passageways through which air may not be drawn for inhalation by a user.

For example, smoking articles according to the invention may comprise combustible heat sources comprising one or more closed passageways that extend from the front face at the upstream end of the combustible heat source only part way along the length combustible heat source.

The inclusion of one or more closed air passageways increases the surface area of the combustible heat source that is exposed to oxygen from the air and may advantageously facilitate ignition and sustained combustion of the combustible heat source.

Smoking articles according to the invention comprising blind combustible heat sources comprise one or more air inlets downstream of the rear face of the combustible heat source for drawing air into the one or more airflow pathways. Smoking articles according to the invention comprising non-blind combustible heat sources may also comprise one or more air inlets downstream of the rear face of the combustible heat source for drawing air into the one or more airflow pathways.

During puffing by a user, cool air drawn into the one or more airflow pathways through air inlets downstream of the rear face of the combustible heat source advantageously reduces the temperature of the aerosol-forming substrate. This substantially prevents or inhibits spikes in the temperature of the aerosol-forming substrate during puffing by a user.

As used herein, the term 'cool air' is used to describe ambient air that is not significantly heated by the combustible heat source upon puffing by a user.

By preventing or inhibiting spikes in the temperature of the aerosol-forming substrate, the inclusion of one or more air inlets downstream of the rear face of the combustible heat source advantageously helps to avoid or reduce combustion or pyrolysis of the aerosol-forming substrate of smoking articles according to the invention under intense puffing regimes. In addition, the inclusion of one or more air inlets downstream of the rear face of the combustible heat source advantageously helps to minimise or reduce the impact of a user's puffing regime on the composition of the mainstream aerosol of smoking articles according to the invention.

Smoking articles according to the invention comprise an outer wrapper that circumscribes at least a rear portion of the combustible heat source, the aerosol-forming substrate and any other components of the smoking article downstream of the aerosol-forming substrate. Smoking articles according to the invention may comprise outer wrappers formed from any suitable material or combination of materials. Suitable materials are well known in the art and include, but are not limited to, cigarette paper. The outer wrapper should grip the combustible heat source and aerosol-forming substrate of the smoking article when the smoking article is assembled.

Where present, the one or more air inlets downstream of the rear face of the combustible heat source for drawing air into the one or more airflow pathways are provided in the outer wrapper and any other materials circumscribing components of smoking articles according to the invention through which air may be drawn into the one or more airflow pathways. As used herein, the term 'air inlet' is used to describe one or more holes, slits, slots or other apertures in the outer wrapper and any other materials circumscribing components of smoking articles according to the invention through which air may be drawn into the one or more airflow pathways.

The number, shape, size and location of the air inlets may be appropriately adjusted to achieve a good smoking performance.

Smoking articles according to the invention may comprise one or more air inlets between a downstream end of the combustible heat source and an upstream end of the aerosol-forming substrate for drawing air into the one or more airflow pathways. Air inlets located between a downstream end of the combustible heat source and an upstream end of the aerosol-forming substrate are referred to herein as first air inlets.

In use, when a user puffs on such a smoking article, air may be drawn into the smoking article through the one or more first air inlets between the downstream end of the combustible heat source and the upstream end of the aerosol-forming substrate. The drawn air then passes through the aerosol-forming substrate as it is drawn downstream through the one or more airflow pathways of the smoking article for inhalation by the user.

Where smoking articles according to the invention comprise a first barrier between the downstream end of the combustible heat source and the upstream end of the aerosol-forming substrate, the one or more first air inlets are located downstream of the first barrier.

Alternatively or in addition to one or more first air inlets, smoking articles according to the invention may comprise one or more air inlets about the periphery of the aerosol-forming substrate for drawing air into the one or more airflow pathways. Air inlets located about the periphery of the aerosol-forming substrate are referred to herein as second air inlets.

In use, when a user puffs on such a smoking article, air may be drawn into the aerosol-forming substrate through the one or more second air inlets. The drawn air then passes through the aerosol-forming substrate as it is drawn downstream through the one or more airflow pathways of the smoking article for inhalation by the user.

Alternatively or in addition to one or more first air inlets or one or more second air inlets, smoking articles according to the invention may comprise one or more air inlets downstream of the aerosol-forming substrate for drawing air into the one or more airflow pathways. Air inlets located downstream of the aerosol-forming substrate are referred to herein as third air inlets.

In use, when a user puffs on such a smoking article, air may be drawn into the smoking article through the one or more third air inlets downstream of the aerosol-forming substrate.

In certain preferred embodiments, smoking articles according to the invention may comprise an airflow pathway extending between one or more third air inlets downstream of the aerosol-forming substrate and a mouth end of the smoking article, wherein the airflow pathway comprises a first portion extending longitudinally upstream from the one or more third air inlets towards the aerosol-forming substrate and a second portion extending longitudinally downstream from the first portion towards the mouth end of the smoking article.

In use, when a user puffs on such a smoking article, air may be drawn into the smoking article through the one or more third air inlets downstream of the aerosol-forming substrate and passes upstream through the first portion of the airflow pathway towards the aerosol-forming substrate. The drawn air then passes downstream through the second portion of the airflow pathway towards the mouth end of the smoking article for inhalation by the user.

Preferably, the first portion of the airflow pathway extends upstream from the one or more third air inlets to the aerosol-forming substrate and the second portion of the airflow pathway extends downstream from the aerosol-forming substrate towards the mouth end of the smoking article.

Smoking articles according to the invention may comprise an airflow directing element downstream of the aerosol-forming substrate. The airflow directing element defines the first portion and the second portion of the airflow pathway extending between the one or more third air inlets downstream of the aerosol-forming substrate and the mouth end of the smoking article. The one or more third air inlets are provided between a downstream end of the aerosol-forming substrate and a downstream end of the airflow directing element. The airflow directing element may abut the aerosol-forming substrate. Alternatively, the airflow directing element may extend into the aerosol-forming substrate. For example, in certain embodiments the airflow directing element may extend a distance of up to 0.5 L into the aerosol-forming substrate, where L is the length of the aerosol-forming substrate.

The airflow directing element may have a length of between about 7 mm and about 50 mm, for example a length of between about 10 mm and about 45 mm or of between about 15 mm and about 30 mm. The airflow directing element may have other lengths depending upon the desired overall length of the smoking article, and the presence and length of other components within the smoking article.

The airflow directing element may comprise an open-ended, substantially air impermeable hollow body. In such embodiments, the exterior of the open-ended, substantially air impermeable hollow body defines one of the first portion of the airflow pathway and the second portion of the airflow pathway and the interior of the open-ended, substantially air impermeable hollow body defines the other of the first portion of the airflow pathway and the second portion of the airflow pathway.

The substantially air impermeable hollow body may be formed from one or more suitable air impermeable materials that are substantially thermally stable at the temperature of the aerosol generated by the transfer of heat from the combustible heat source to the aerosol-forming substrate. Suitable materials are known in the art and include, but are not limited to, cardboard, plastic, ceramic and combinations thereof.

Preferably, the exterior of the open-ended, substantially air impermeable hollow body defines the first portion of the airflow pathway and the interior of the open-ended, substantially air impermeable hollow body defines the second portion of the airflow pathway.

In one preferred embodiment, the open-ended, substantially air impermeable hollow body is a cylinder, preferably a right circular cylinder.

In another preferred embodiment, the open-ended, substantially air impermeable hollow body is a truncated cone, preferably a truncated right circular cone.

The open-ended, substantially air impermeable hollow body may have a length of between about 7 mm and about 50 mm, for example a length of between about 10 mm and about 45 mm or between about 15 mm and about 30 mm. The open-ended, substantially air impermeable hollow body may have other lengths depending upon the desired overall length of the smoking article, and the presence and length of other components within the smoking article.

Where the open-ended, substantially air impermeable hollow body is a cylinder, the cylinder may have a diameter of between about 2 mm and about 5 mm, for example a diameter of between about 2.5 mm and about 4.5 mm. The cylinder may have other diameters depending upon the desired overall diameter of the smoking article.

Where the open-ended, substantially air impermeable hollow body is a truncated cone, the upstream end of the truncated cone may have a diameter of between about 2 mm and about 5 mm, for example a diameter of between about 2.5 mm and about 4.5 mm. The upstream end of the truncated cone may have other diameters depending upon the desired overall diameter of the smoking article Where the open-ended, substantially air impermeable hollow body is a truncated cone, the downstream end of the truncated cone may have a diameter of between about 5 mm and about 9 mm, for example of between about 7 mm and about 8 mm. The downstream end of the truncated cone may have other diameters depending upon the desired overall diameter of the smoking article. Preferably, the downstream end of the truncated cone is of substantially the same diameter as the aerosol-forming substrate.

The open-ended, substantially air impermeable hollow body may abut the aerosol-forming substrate. Alternatively, the open-ended, substantially air impermeable hollow body may extend into the aerosol-forming substrate. For example, in certain embodiments the open-ended, substantially air impermeable hollow body may extend a distance of up to 0.5

L into the aerosol-forming substrate, where L is the length of the aerosol-forming substrate.

The upstream end of the substantially air impermeable hollow body is of reduced diameter compared to the aerosol-forming substrate.

In certain embodiments, the downstream end of the substantially air impermeable hollow body is of reduced diameter compared to the aerosol-forming substrate.

In other embodiments, the downstream end of the substantially air impermeable hollow body is of substantially the same diameter as the aerosol-forming substrate.

Where the downstream end of the substantially air impermeable hollow body is of reduced diameter compared to the aerosol-forming substrate, the substantially air impermeable hollow body may be circumscribed by a substantially air impermeable seal. In such embodiments, the substantially air impermeable seal is located downstream of the one or more third inlets. The substantially air impermeable seal may be of substantially the same diameter as the aerosol-forming substrate. For example, in some embodiments the downstream end of the substantially air impermeable hollow body may be circumscribed by a substantially impermeable plug or washer of substantially the same diameter as the aerosol-forming substrate.

The substantially air impermeable seal may be formed from one or more suitable air impermeable materials that are substantially thermally stable at the temperature of the aerosol generated by the transfer of heat from the combustible heat source to the aerosol-forming substrate. Suitable materials are known in the art and include, but are not limited to, cardboard, plastic, wax, silicone, ceramic and combinations thereof.

At least a portion of the length of the open-ended, substantially air impermeable hollow body may be circumscribed by an air permeable diffuser. The air permeable diffuser may be of substantially the same diameter as the aerosol-forming substrate. The air permeable diffuser may be formed from one or more suitable air permeable materials that are substantially thermally stable at the temperature of the aerosol generated by the transfer of heat from the combustible heat source to the aerosol-forming substrate. Suitable air permeable materials are known in the art and include, but are not limited to, porous materials such as, for example, cellulose acetate tow, cotton, open-cell ceramic and polymer foams, tobacco material and combinations thereof. In certain preferred embodiments, the air permeable diffuser comprises a substantially homogeneous, air permeable porous material.

In one preferred embodiment, the airflow directing element comprises an open ended, substantially air impermeable, hollow tube of reduced diameter compared to the aerosol-forming substrate and an annular substantially air impermeable seal of substantially the same outer diameter as the aerosol-forming substrate, which circumscribes the hollow tube downstream of the one or more third air inlets.

In this embodiment, the volume bounded radially by the exterior of the hollow tube and an outer wrapper of the smoking article defines the first portion of the airflow pathway that extends longitudinally upstream from the one or more third air inlets towards the aerosol-forming substrate and the volume bounded radially by the interior of the hollow tube defines the second portion of the airflow pathway that extends longitudinally downstream towards the mouth end of the smoking article.

The airflow directing element may further comprise an inner wrapper, which circumscribes the hollow tube and the annular substantially air impermeable seal.

In this embodiment, the volume bounded radially by the exterior of the hollow tube and the inner wrapper of the airflow directing element defines the first portion of the airflow pathway that extends longitudinally upstream from the one or more third air inlets towards the aerosol-forming substrate and the volume bounded by the interior of the hollow tube defines the second portion of the airflow pathway that extends longitudinally downstream towards the mouth end of the smoking article.

The open upstream end of the hollow tube may abut a downstream end of the aerosol-forming substrate. Alternatively, the open upstream end of the hollow tube may be inserted or otherwise extend into the downstream end of the aerosol-forming substrate.

The airflow directing element may further comprise an annular air permeable diffuser of substantially the same outer diameter as the aerosol-forming substrate, which circumscribes at least a portion of the length of the hollow tube upstream of the annular substantially air impermeable seal. For example, the hollow tube may be at least partially embedded in a plug of cellulose acetate tow.

Where the airflow directing element further comprises an inner wrapper, the inner wrapper may circumscribe the hollow tube, the annular substantially air impermeable seal and the annular air permeable diffuser.

In use, when a user draws on the mouth end of the smoking article, cool air is drawn into the smoking article through the one or more third air inlets downstream of the aerosol-forming substrate. The drawn air passes upstream to the aerosol-forming substrate along the first portion of the airflow pathway between the exterior of the hollow tube and the outer wrapper of the smoking article or inner wrapper of the airflow directing element. The drawn air passes through the aerosol-forming substrate and then passes downstream along the second portion of the airflow pathway through the interior of the hollow tube towards the mouth end of the smoking article for inhalation by the user.

Where the airflow directing element comprises an annular air permeable diffuser, the drawn air passes through the annular air permeable diffuser as it passes upstream along the first portion of the airflow pathway towards the aerosol-forming substrate.

In another preferred embodiment, the airflow directing element comprises an open ended, substantially air impermeable, truncated hollow cone having an upstream end of reduced diameter compared to the aerosol-forming substrate and a downstream end of substantially the same diameter as the aerosol-forming substrate.

In this embodiment, the volume bounded radially by the exterior of the truncated hollow cone and an outer wrapper of the smoking article defines the first portion of the airflow pathway that extends longitudinally upstream from the one or more third air inlets towards the aerosol-forming substrate and the volume bounded radially by the interior of the truncated hollow cone defines the second portion of the airflow pathway that extends longitudinally downstream towards the mouth end of the smoking article.

The open upstream end of the truncated hollow cone may abut a downstream end of the aerosol-forming substrate. Alternatively, the open upstream end of the truncated hollow cone may be inserted or otherwise extend into the downstream end of the aerosol-forming substrate.

The airflow directing element may further comprise an annular air permeable diffuser of substantially the same outer diameter as the aerosol-forming substrate, which circumscribes at least a portion of the length of the truncated hollow cone. For example, the truncated hollow cone may be at least partially embedded in a plug of cellulose acetate tow.

In use, when a user draws on the mouth end of the smoking article, cool air is drawn into the smoking article through the one or more third air inlets downstream of the aerosol-forming substrate. The drawn air passes upstream to the aerosol-forming substrate along the first portion of the airflow pathway between the outer wrapper of the smoking article and the exterior of the truncated hollow cone of the airflow directing element. The drawn air passes through the aerosol-forming substrate and then passes downstream along the second portion of the airflow pathway through the interior of the truncated hollow cone towards the mouth end of the smoking article for inhalation by the user.

Where the airflow directing element comprises an annular air permeable diffuser, the drawn air passes through the annular air permeable diffuser as it passes upstream along the first portion of the airflow pathway towards the aerosol-forming substrate.

It will be appreciated that smoking articles according to the invention may comprise one or more first air inlets between a downstream end of the combustible heat source and an upstream end of the aerosol-forming substrate, or one or more second air inlets about the periphery of the aerosol-forming substrate, or one or more third air inlets downstream of the aerosol-forming substrate, or any combination thereof.

Preferably, the combustible heat source is a carbonaceous heat source. As used herein, the term 'carbonaceous' is used to describe a combustible heat source comprising carbon.

Preferably, combustible carbonaceous heat sources for use in smoking articles according to the invention have a carbon content of at least about 35 percent, more preferably of at least about 40 percent, most preferably of at least about 45 percent by dry weight of the combustible heat source.

In some embodiments, combustible heat sources according to the invention are combustible carbon-based heat sources. As used herein, the term 'carbon-based heat source' is used to describe a heat source comprised primarily of carbon.

Combustible carbon-based heat sources for use in smoking articles according to the invention may have a carbon content of at least about 50 percent, preferably of at least about 60 percent, more preferably of at least about 70 percent, most preferably of at least about 80 percent by dry weight of the combustible carbon-based heat source.

Smoking articles according to the invention may comprise combustible carbonaceous heat sources formed from one or more suitable carbon-containing materials.

If desired, one or more binders may be combined with the one or more carbon-containing materials. Preferably, the one or more binders are organic binders. Suitable known organic binders, include but are not limited to, gums (for example, guar gum), modified celluloses and cellulose derivatives (for example, methyl cellulose, carboxymethyl cellulose, hydroxypropyl cellulose and hydroxypropyl methylcellulose) flour, starches, sugars, vegetable oils and combinations thereof.

In one preferred embodiment, the combustible heat source is formed from a mixture of carbon powder, modified cellulose, flour and sugar.

Instead of, or in addition to one or more binders, combustible heat sources for use in smoking articles according to the invention may comprise one or more additives in order to improve the properties of the combustible heat source. Suitable additives include, but are not limited to, additives to promote consolidation of the combustible heat source (for example, sintering aids), additives to promote ignition of the combustible heat source (for example, oxidisers such as perchlorates, chlorates, nitrates, peroxides, permanganates, zirconium and combinations thereof), additives to promote combustion of the combustible heat source (for example, potassium and potassium salts, such as potassium citrate) and additives to promote decomposition of one or more gases produced by combustion of the combustible heat source (for example catalysts, such as CuO, $Fe_2O_3$ and $Al_2O_3$).

Where smoking articles according to the invention comprise a first barrier comprising a first barrier coating provided on the rear face of the combustible heat source, such additives may be incorporated in the combustible heat source prior to or after application of the first barrier coating to the rear face of the combustible heat source.

In one preferred embodiment, the combustible heat source is a cylindrical combustible heat source comprising carbon and at least one ignition aid, the cylindrical combustible heat source having a front end face (that is, upstream end face) and an opposed rear face (that is, downstream end face), wherein at least part of the cylindrical combustible heat source between the front face and the rear face is wrapped in a combustion resistant wrapper and wherein upon ignition of the front face of the cylindrical combustible heat source the rear face of the cylindrical combustible heat source increases in temperature to a first temperature and wherein during subsequent combustion of the cylindrical combustible heat source the rear face of the cylindrical combustible heat source maintains a second temperature lower than the first temperature.

As used herein, the term 'ignition aid' is used to denote a material that releases one or both of energy and oxygen during ignition of the combustible heat source, where the rate of release of one or both of energy and oxygen by the material is not ambient oxygen diffusion limited. In other words, the rate of release of one or both of energy and oxygen by the material during ignition of the combustible heat source is largely independent of the rate at which ambient oxygen can reach the material. As used herein, the term 'ignition aid' is also used to denote an elemental metal that releases energy during ignition of the combustible heat source, wherein the ignition temperature of the elemental metal is below about 500° C. and the heat of combustion of the elemental metal is at least about 5 kJ/g.

As used herein, the term 'ignition aid' does not include alkali metal salts of carboxylic acids (such as alkali metal citrate salts, alkali metal acetate salts and alkali metal succinate salts), alkali metal halide salts (such as alkali metal chloride salts), alkali metal carbonate salts or alkali metal phosphate salts, which are believed to modify carbon combustion. Even when present in a large amount relative to the total weight of the combustible heat source, such alkali metal burn salts do not release enough energy during ignition of a combustible heat source to produce an acceptable aerosol during early puffs.

Examples of suitable oxidizing agents include, but are not limited to: nitrates such as, for example, potassium nitrate, calcium nitrate, strontium nitrate, sodium nitrate, barium nitrate, lithium nitrate, aluminium nitrate and iron nitrate; nitrites; other organic and inorganic nitro compounds; chlorates such as, for example, sodium chlorate and potassium chlorate; perchlorates such as, for example, sodium perchlorate; chlorites; bromates such as, for example, sodium bromate and potassium bromate; perbromates; bromites; borates such as, for example, sodium borate and potassium borate; ferrates such as, for example, barium ferrate; ferrites; manganates such as, for example, potassium manganate; permanganates such as, for example, potassium permanganate; organic peroxides such as, for example, benzoyl peroxide and acetone peroxide; inorganic peroxides such as, for example, hydrogen peroxide, strontium peroxide, magnesium peroxide, calcium peroxide, barium peroxide, zinc peroxide and lithium peroxide; superoxides such as, for example, potassium superoxide and sodium superoxide; iodates; periodates; iodites; sulphates; sulfites; other sulfoxides; phosphates; phosphinates; phosphites; and phosphanites.

While advantageously improving the ignition and combustion properties of the combustible heat source, the inclusion of ignition and combustion additives can give rise to undesirable decomposition and reaction products during use of the smoking article. For example, decomposition of nitrates included in the combustible heat source to aid ignition thereof can result in the formation of nitrogen oxides. Isolating the combustible heat source from the one or more airflow pathways through the smoking article advantageously prevents or inhibits such decomposition and reaction products from entering air drawn through the smoking article during use thereof.

In addition, the inclusion of oxidisers, such as nitrates or other additives to aid ignition can result in generation of hot gases and high temperatures in the combustible heat source during ignition of the combustible heat source. Isolating the combustible heat source from the one or more airflow pathways through the smoking article advantageously limits the temperature to which the aerosol-forming substrate is exposed, and so helps to avoid or reduce thermal degradation or combustion of the aerosol-forming substrate during ignition of the combustible heat source.

Combustible carbonaceous heat sources for use in smoking articles according to the invention, are preferably formed by mixing one or more carbon-containing materials with one or more binders and other additives, where included, and pre-forming the mixture into a desired shape. The mixture of one or more carbon containing materials, one or more binders and optional other additives may be pre-formed into a desired shape using any suitable known ceramic forming methods such as, for example, slip casting, extrusion, injection moulding and die compaction. In certain preferred embodiments, the mixture is pre-formed into a desired shape by extrusion.

Preferably, the mixture of one or more carbon-containing materials, one or more binders and other additives is pre-formed into an elongate rod. However, it will be appreciated that the mixture of one or more carbon-containing materials, one or more binders and other additives may be pre-formed into other desired shapes.

After formation, particularly after extrusion, the elongate rod or other desired shape is preferably dried to reduce its moisture content and then pyrolysed in a non-oxidizing atmosphere at a temperature sufficient to carbonise the one or more binders, where present, and substantially eliminate any volatiles in the elongate rod or other shape. The elongate rod or other desired shape is pyrolysed preferably in a nitrogen atmosphere at a temperature of between about 700° C. and about 900° C.

In one embodiment, at least one metal nitrate salt is incorporated in the combustible heat source by including at least one metal nitrate precursor in the mixture of one or more carbon containing materials, one or more binders and other additives. The at least one metal nitrate precursor is then subsequently converted in-situ into at least one metal nitrate salt by treating the pyrolysed pre-formed cylindrical rod or other shape with an aqueous solution of nitric acid. In one embodiment, the combustible heat source comprises at least one metal nitrate salt having a thermal decomposition temperature of less than about 600° C., more preferably of less than about 400° C. Preferably, the at least one metal nitrate salt has a decomposition temperature of between about 150° C. and about 600° C., more preferably of between about 200° C. and about 400° C.

In preferred embodiments, exposure of the combustible heat source to a conventional yellow flame lighter or other ignition means should cause the at least one metal nitrate salt to decompose and release oxygen and energy. This decomposition causes an initial boost in the temperature of the combustible heat source and also aids in the ignition of the combustible heat source. Following decomposition of the at least one metal nitrate salt, the combustible heat source preferably continues to combust at a lower temperature.

The inclusion of at least one metal nitrate salt advantageously results in ignition of the combustible heat source being initiated internally, and not only at a point on the surface thereof. Preferably, the at least one metal nitrate salt is present in the combustible heat source in an amount of between about 20 percent by dry weight and about 50 percent by dry weight of the combustible heat source.

In another embodiment, the combustible heat source comprises at least one peroxide or superoxide that actively evolves oxygen at a temperature of less than about 600° C., more preferably at a temperature of less than about 400° C.

Preferably, the at least one peroxide or superoxide actively evolves oxygen at a temperature of between about 150° C. and about 600° C., more preferably at a temperature of between about 200° C. and about 400° C., most preferably at a temperature of about 350° C.

In use, exposure of the combustible heat source to a conventional yellow flame lighter or other ignition means should cause the at least one peroxide or superoxide to decompose and release oxygen. This causes an initial boost in the temperature of the combustible heat source and also aids in the ignition of the combustible heat source. Following decomposition of the at least one peroxide or superoxide, the combustible heat source preferably continues to combust at a lower temperature.

The inclusion of at least one peroxide or superoxide advantageously results in ignition of the combustible heat source being initiated internally, and not only at a point on the surface thereof.

The combustible heat source preferably has a porosity of between about 20 percent and about 80 percent, more preferably of between about 20 percent and 60 percent. Where the combustible heat source comprises at least one metal nitrate salt, this advantageously allows oxygen to diffuse into the mass of the combustible heat source at a rate sufficient to sustain combustion as the at least one metal nitrate salt decomposes and combustion proceeds. Even more preferably, the combustible heat source has a porosity of between about 50 percent and about 70 percent, more preferably of between about 50 percent and about 60 percent as measured by, for example, mercury porosimetry or helium pycnometry. The required porosity may be readily achieved during production of the combustible heat source using conventional methods and technology.

Advantageously, combustible carbonaceous heat sources for use in smoking articles according to the invention have an apparent density of between about 0.6 g/cm$^3$ and about 1 g/cm$^3$.

Preferably, the combustible heat source has a mass of between about 300 mg and about 500 mg, more preferably of between about 400 mg and about 450 mg.

Preferably, the combustible heat source has a length of between about 7 mm and about 17 mm, more preferably of between about 7 mm and about 15 mm, most preferably of between about 7 mm and about 13 mm.

Preferably, the combustible heat source has a diameter of between about 5 mm and about 9 mm, more preferably of between about 7 mm and about 8 mm.

Preferably, the combustible heat source is of substantially uniform diameter. However, the combustible heat source may alternatively be tapered so that the diameter of the rear portion of the combustible heat source is greater than the diameter of the front portion thereof. Particularly preferred are combustible heat sources that are substantially cylindrical. The combustible heat source may, for example, be a cylinder or tapered cylinder of substantially circular cross-section or a cylinder or tapered cylinder of substantially elliptical cross-section.

Smoking articles according to the invention preferably comprise an aerosol-forming substrate comprising at least one aerosol-former. In such embodiments, isolation of the combustible heat source from the aerosol-forming substrate advantageously prevents or inhibits migration of the at least one aerosol-former from the aerosol-forming substrate to the combustible heat source during storage of the smoking articles. In such embodiments, isolation of the combustible heat source from the one or more airflow pathways may also advantageously substantially prevent or inhibit migration of the at least one aerosol former from the aerosol-forming substrate to the combustible heat source during use of the smoking articles. Decomposition of the at least one aerosol-former during use of the smoking articles is thus advantageously substantially avoided or reduced.

The at least one aerosol-former may be any suitable known compound or mixture of compounds that, in use, facilitates formation of a dense and stable aerosol and that is substantially resistant to thermal degradation at the operating temperature of the smoking article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in smoking articles according to the invention are polyhydric alcohols or mixtures thereof, such as triethylene glycol, 1,3-butanediol and, most preferred, glycerine.

The combustible heat source and aerosol-forming substrate of smoking articles according to the invention may substantially abut one another. Alternatively, the combustible heat source and aerosol-forming substrate of smoking articles according to the invention may be longitudinally spaced apart from one another one another.

Preferably, smoking articles according to the invention further comprise a heat-conducting element around and in direct contact with a rear portion of the combustible heat source and an adjacent front portion of the aerosol-forming substrate. The heat-conducting element is preferably combustion resistant and oxygen restricting.

The heat-conducting element is around and in direct contact with the peripheries of both the rear portion of the combustible heat source and the front portion of the aerosol-forming substrate. The heat-conducting element provides a thermal link between these two components of smoking articles according to the invention.

Suitable heat-conducting elements for use in smoking articles according to the invention include, but are not limited to: metal foil wrappers such as, for example, aluminium foil wrappers, steel wrappers, iron foil wrappers and copper foil wrappers; and metal alloy foil wrappers.

Preferably, the rear portion of the combustible heat source surrounded by the heat-conducting element is between about 2 mm and about 8 mm in length, more preferably between about 3 mm and about 5 mm in length.

Preferably, the front portion of the combustible heat source not surrounded by the heat-conducting element is between about 4 mm and about 15 mm in length, more preferably between about 4 mm and about 8 mm in length.

Preferably, the aerosol-forming substrate has a length of between about 5 mm and about 20 mm, more preferably of between about 8 mm and about 12 mm.

In certain preferred embodiments, the aerosol-forming substrate extends at least about 3 mm downstream beyond the heat-conducting element.

Preferably, the front portion of the aerosol-forming substrate surrounded by the heat-conducting element is between about 2 mm and about 10 mm in length, more preferably between about 3 mm and about 8 mm in length, most preferably between about 4 mm and about 6 mm in length. Preferably, the rear portion of the aerosol-forming substrate not surrounded by the heat-conducting element is between about 3 mm and about 10 mm in length. In other words, the aerosol-forming substrate preferably extends between about 3 mm and about 10 mm downstream beyond the heat-conducting element. More preferably, the aerosol-forming substrate extends at least about 4 mm downstream beyond the heat-conducting element.

In other embodiments, the aerosol-forming substrate may extend less than 3 mm downstream beyond the heat-conducting element.

In yet further embodiments, the entire length of the aerosol-forming substrate may be surrounded by the heat-conducting element.

Preferably, smoking articles according to the invention comprise aerosol-forming substrates comprising at least one aerosol-former and a material capable of emitting volatile compounds in response to heating. Preferably, the material capable of emitting volatile compounds in response to heating is a charge of plant-based material, more preferably a charge of homogenised plant-based material. For example, the aerosol-forming substrate may comprise one or more materials derived from plants including, but not limited to: tobacco; tea, for example green tea; peppermint; laurel; *eucalyptus*; basil; sage; *verbena*; and tarragon. The plant based-material may comprise additives including, but not limited to, humectants, flavourants, binders and mixtures thereof. Preferably, the plant-based material consists essentially of tobacco material, most preferably homogenised tobacco material.

Smoking articles according to the invention preferably further comprise an expansion chamber downstream of the aerosol-forming substrate and, where present, downstream of the airflow directing element. The inclusion of an expansion chamber advantageously allows further cooling of the aerosol generated by heat transfer from the combustible heat source to the aerosol-forming substrate. The expansion chamber also advantageously allows the overall length of smoking articles according to the invention to be adjusted to a desired value, for example to a length similar to that of conventional cigarettes, through an appropriate choice of the length of the expansion chamber. Preferably, the expansion chamber is an elongate hollow tube.

Smoking articles according to the invention may also further comprise a mouthpiece downstream of the aerosol-forming substrate and, where present, downstream of the airflow directing element and expansion chamber. Preferably, the mouthpiece is of low filtration efficiency, more preferably of very low filtration efficiency. The mouthpiece may be a single segment or component mouthpiece. Alternatively, the mouthpiece may be a multi-segment or multi-component mouthpiece.

The mouthpiece may, for example, comprise a filter made of cellulose acetate, paper or other suitable known filtration materials. Alternatively or in addition, the mouthpiece may comprise one or more segments comprising absorbents, adsorbents, flavourants, and other aerosol modifiers and additives or combinations thereof.

Features described in relation to one aspect of the invention may also be applicable to other aspects of the invention. In particular, features described in relation to smoking articles and combustible heat sources according to the invention may also be applicable to methods according to the invention.

Figure 2:
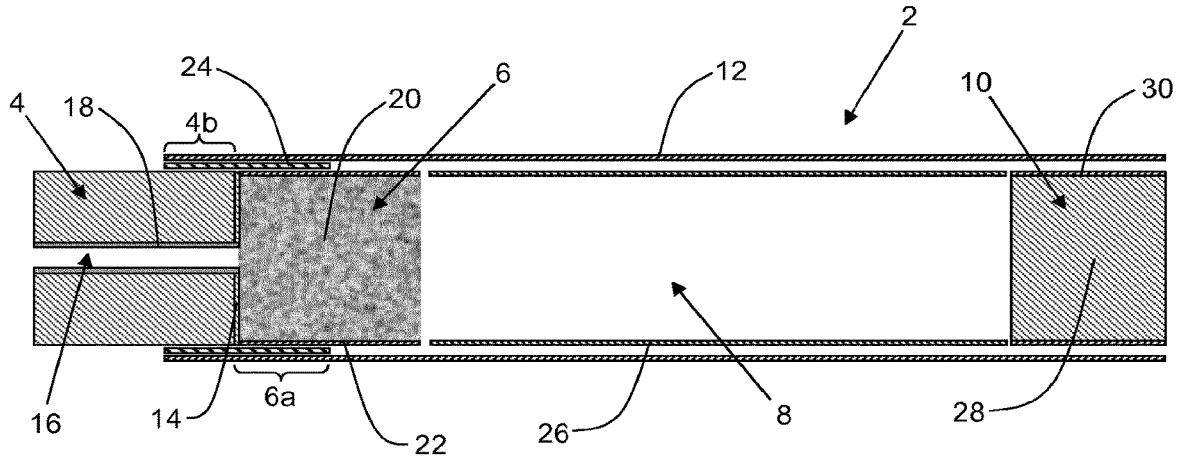
FIG. 2 shows a schematic longitudinal cross-section of the smoking article according to the first embodiment of the invention shown in FIG. 1A.

The smoking article 2 according to the first embodiment of the invention shown in FIGS. 1A and 2 comprises a combustible carbonaceous heat source 4, an aerosol-forming substrate 6, an elongate expansion chamber 8 and a mouthpiece 10 in abutting coaxial alignment. The combustible carbonaceous heat source 4, aerosol-forming substrate 6, elongate expansion chamber 8 and mouthpiece 10 are overwrapped in an outer wrapper of cigarette paper 12 of low air permeability.

As shown in FIG. 2, a non-combustible, substantially air impermeable, first barrier coating 14 is provided on the entire rear face of the combustible carbonaceous heat source 4.

The combustible carbonaceous heat source 4 comprises a central airflow channel 16 that extends longitudinally through the combustible carbonaceous heat source 4 and the non-combustible, substantially air impermeable, first barrier coating 14. A non-combustible, substantially air impermeable second barrier coating 18 is provided on the entire inner surface of the central airflow channel 16.

The aerosol-forming substrate 6 is located immediately downstream of the rear face of the combustible carbonaceous heat source 4 and comprises a cylindrical plug of tobacco material 20 comprising glycerine as aerosol former and circumscribed by filter plug wrap 22.

A heat-conducting element 24 consisting of a tube of aluminium foil surrounds and is in direct contact with a rear portion 4*b* of the combustible carbonaceous heat source 4 and an abutting front portion 6*a* of the aerosol-forming substrate 6. As shown in FIG. 2, a rear portion of the aerosol-forming substrate 6 is not surrounded by the heat-conducting element 24.

The elongate expansion chamber 8 is located downstream of the aerosol-forming substrate 6 and comprises a cylindrical open-ended hollow tube 26 of cardboard which is of substantially the same diameter as the aerosol-forming substrate 6. The mouthpiece 10 of the smoking article 2 is located downstream of the expansion chamber 8 and comprises a cylindrical plug 28 of cellulose acetate tow of very low filtration efficiency circumscribed by filter plug wrap 30. The mouthpiece 10 may be circumscribed by tipping paper (not shown).

In use, the user ignites the combustible carbonaceous heat source 4 and then draws on the mouthpiece 10 to draw air downstream through the central airflow channel 16 of the combustible carbonaceous heat source 4. The front portion 6*a* of the aerosol-forming substrate 6 is heated primarily by conduction through the abutting rear portion 4*b* of the combustible carbonaceous heat source 4 and the heat-conducting element 24. The drawn air is heated as it passes through the central airflow channel 16 of the combustible carbonaceous heat source 4 and then heats the aerosol-forming substrate 6 by convection. The heating of the aerosol-forming substrate 6 by conduction and convection releases volatile and semi-volatile compounds and glycerine from the plug of tobacco material 20, which are entrained in the heated drawn air as it flows through the aerosol-forming substrate 6. The heated air and entrained compounds pass downstream through the expansion chamber 8, cool and condense to form an aerosol that passes through the mouthpiece 10 into the mouth of the user.

The airflow pathway through the smoking article 2 according to the first embodiment of the invention is illustrated by the dotted arrow in FIG. 1A. The non-combustible, substantially air impermeable, first barrier coating 14 provided on the rear face of the combustible carbonaceous heat source 4 and the non-combustible, substantially air impermeable second barrier coating 18 provided on the inner surface of the central airflow channel 16 isolate the combustible carbonaceous heat source 4 from the airflow pathway such that, in use, air drawn through the smoking article 2 along the airflow pathway does not directly contact the combustible carbonaceous heat source 4.

Smoking articles according to the first embodiment of the invention shown in FIGS. 1A and 2 having the dimensions shown in Table 1 were assembled using combustible carbonaceous heat sources produced in accordance with Example 1 and 6 below.

TABLE 1

| Smoking article | First embodiment |
|---|---|
| Overall length (mm) | 70 |
| Diameter (mm) | 7.9 |
| Porous carbonaceous heat source | |
| Length (mm) | 11 |
| Diameter (mm) | 7.8 |
| Diameter of airflow channel (mm) | 1.85-3.50 |
| Thickness of first barrier coating (microns) | ≤500 |
| Thickness of second barrier coating (microns) | ≤300 |
| Aerosol-forming substrate | |
| Length (mm) | 10 |
| Diameter (mm) | 7.8 |
| Density (g/cm$^3$) | 0.8 |
| Aerosol former | Glycerine |
| Amount of aerosol former | 20% by dry wt. of |
| Expansion chamber | |
| Length (mm) | 42 |
| Diameter (mm) | 7.8 |
| Mouthpiece | |
| Length (mm) | 7 |
| Diameter (mm) | 7.8 |
| Heat-conducting element | |
| Length (mm) | 9 |
| Diameter (mm) | 7.8 |
| Thickness of aluminium foil (microns) | 20 |
| Length of rear portion of combustible carbonaceous heat source (mm) | 4 |
| Length of front portion of aerosol-forming substrate (mm) | 5 |
| Length of rear portion of aerosol-forming substrate (mm) | 5 |

Figure 1B:
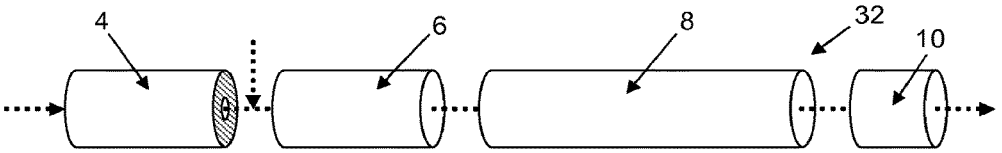
FIG. 1B shows an exploded view of a smoking article according to a second embodiment of the invention comprising a non-blind combustible heat source.

The smoking article 32 according to the second embodiment of the invention shown in FIG. 1B is of largely identical construction to the smoking article according to the first embodiment of the invention shown in FIGS. 1A and 2. However, in the smoking article 32 according to the second embodiment of the invention the combustible carbonaceous heat source 4 and the aerosol-forming substrate 6 are spaced apart from one another along the length of the smoking article. A circumferential arrangement of first air inlets is provided in the cigarette paper 12 and heat conducting element 24 between the downstream end of the combustible carbonaceous heat source 4 and the upstream end of the aerosol-forming substrate 6 to admit cool air into the space between the combustible carbonaceous heat source 4 and the aerosol-forming substrate 6.

In use when a user draws on the mouthpiece 10 of the smoking article 32 according to the second embodiment of the invention, air is drawn downstream through the central airflow channel 16 of the combustible carbonaceous heat source 4 and air is also drawn into the space between the combustible carbonaceous heat source 4 and the aerosol-forming substrate 6 through the first air inlets in the cigarette paper 12 and heat conducting element 24. Mixing of cool air drawn through the first air inlets with heated air drawn through the central airflow channel 16 of the combustible carbonaceous heat source 4 reduces the temperature of the air drawn through the aerosol-forming substrate 6 of the smoking article 32 according to the second embodiment of the invention during puffing by a user.

The airflow pathways through the smoking article 32 according to the second embodiment of the invention are illustrated by the dotted arrows in FIG. 1B. The non-combustible, substantially air impermeable, first barrier coating 14 provided on the rear face of the combustible carbonaceous heat source 4 and the non-combustible, substantially air impermeable second barrier coating 18 provided on the inner surface of the central airflow channel 16 isolate the combustible carbonaceous heat source 4 from the airflow pathways such that, in use, air drawn through the smoking article 2 along the airflow pathway does not directly contact the combustible carbonaceous heat source 4.

Figure 1C:
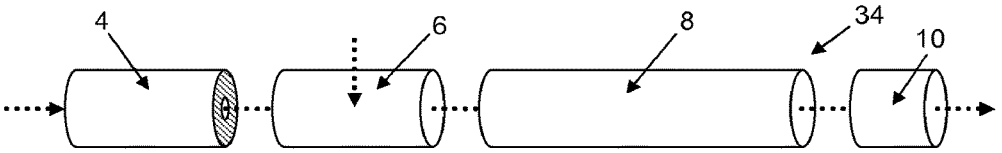
FIG. 1C shows an exploded view of a smoking article according to a third embodiment of the invention comprising a non-blind combustible heat source.

The smoking article 34 according to the third embodiment of the invention shown in FIG. 1C is also of largely identical construction to the smoking article according to the first embodiment of the invention shown in FIGS. 1A and 2. However, in the smoking article 34 according to the third embodiment of the invention a circumferential arrangement of second air inlets is provided in the cigarette paper 12 and filter plug wrap 22 circumscribing the aerosol-forming substrate 6 to admit cool air into the aerosol-forming substrate 6.

In use when a user draws on the mouthpiece 10 of the smoking article 34 according to the second embodiment of the invention, air is drawn downstream through the central airflow channel 16 of the combustible carbonaceous heat source 4 and air is also drawn into the aerosol-forming substrate 6 through the second air inlets in the cigarette paper 12 and filter plug wrap 22. The cool air drawn through the second air inlets reduces the temperature of the aerosol-forming substrate 6 of the smoking article 32 according to the third embodiment of the invention during puffing by a user.

The airflow pathways through the smoking article 34 according to the third embodiment of the invention are illustrated by the dotted arrows in FIG. 1C. The non-combustible, substantially air impermeable, first barrier coating 14 provided on the rear face of the combustible carbonaceous heat source 4 and the non-combustible, substantially air impermeable second barrier coating 18 provided on the inner surface of the central airflow channel 16 isolate the combustible carbonaceous heat source 4 from the airflow pathways such that, in use, air drawn through the smoking article 2 along the airflow pathways does not directly contact the combustible carbonaceous heat source 4.

Figure 1D:
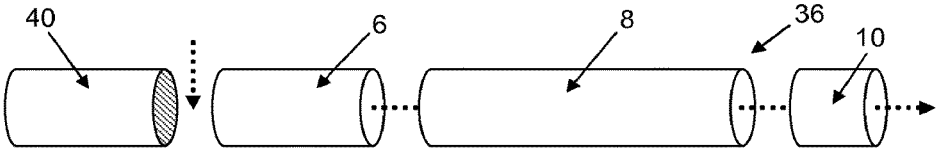
FIG. 1D shows an exploded view of a smoking article according to a fourth embodiment of the invention comprising a blind combustible heat source.
Figure 1E:
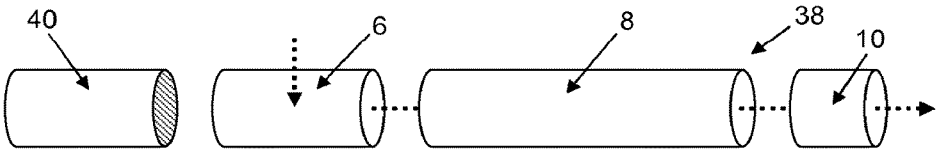
FIG. 1E shows an exploded view of a smoking article according to a fifth embodiment of the invention comprising a blind combustible heat source.

The smoking articles 36, 38 according to the fourth and fifth embodiments of the invention shown in FIGS. 1D and 1E are of largely identical construction to the smoking articles according to the second and third embodiments of the invention shown in FIGS. 1B and 1C, respectively, and may be assembled in an analogous manner. However, the smoking articles 36, 38 according to the fourth and fifth embodiments of the invention comprise combustible carbonaceous heat sources 38 that do not comprise a central airflow channel 16. A non-combustible, substantially air impermeable, first barrier coating 14 is provided on the entire rear face of the combustible carbonaceous heat sources 38 of the smoking articles 36, 38 according to the fourth and fifth embodiments of the invention.

In use, when a user draws on the mouthpiece 10 of the smoking articles 36, 38 according to the fourth and fifth embodiments of the invention, no air is drawn through the combustible carbonaceous heat sources 38. Consequently, the aerosol-forming substrate 6 is heated exclusively by conduction through the abutting rear portion 4*b* of the combustible carbonaceous heat source 4 and the heat-conducting element 24.

The airflow pathways through the smoking articles 36, 38 according to the fourth and fifth embodiments of the invention are illustrated by the dotted arrows in FIGS. 1D and 1E. The non-combustible, substantially air impermeable, first barrier coating 14 provided on the entire rear face of the combustible carbonaceous heat sources 38 of the smoking articles 36, 38 according to the fourth and fifth embodiments of the invention isolates the combustible carbonaceous heat sources 38 from the airflow pathways such that, in use, air drawn through the smoking articles 36, 38 along the airflow pathways does not directly contact the combustible carbonaceous heat sources 38.

Figure 3:
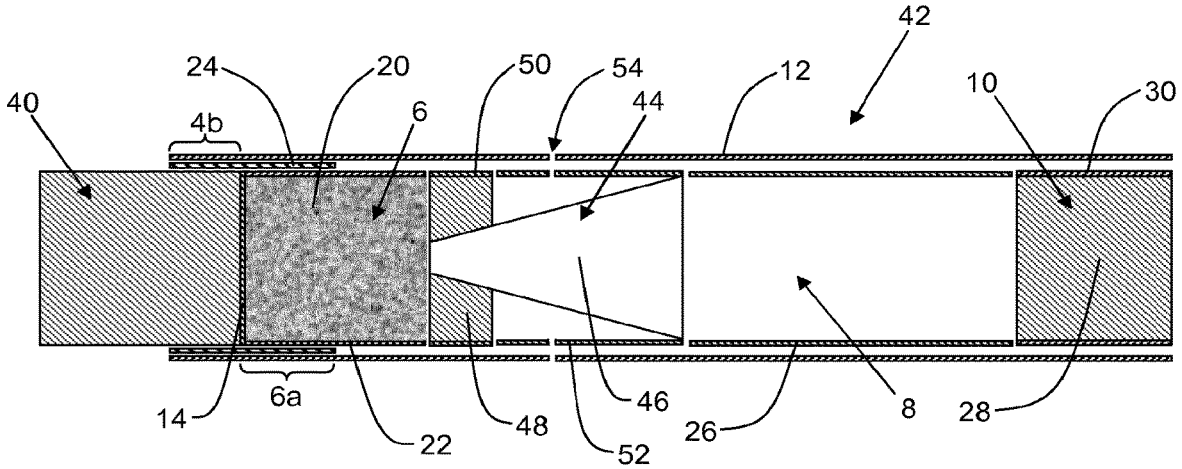
FIG. 3 shows a schematic longitudinal cross-section of a smoking article according to a sixth embodiment of the invention comprising a blind combustible heat source.

The smoking article 42 according to the sixth embodiment of the invention shown in FIG. 3 comprises a combustible carbonaceous heat source 40, an aerosol-forming substrate 6, an airflow directing element 44, an elongate expansion chamber 8 and a mouthpiece 10 in abutting coaxial alignment. The combustible carbonaceous heat source 40, aerosol-forming substrate 6, airflow directing element 44, elongate expansion chamber 8 and mouthpiece 10 are overwrapped in an outer wrapper of cigarette paper 12 of low air permeability.

As shown in FIG. 3, a non-combustible, substantially air impermeable, first barrier coating 14 is provided on the entire rear face of the combustible carbonaceous heat source 40.

The aerosol-forming substrate 6 is located immediately downstream of the combustible carbonaceous heat source 40 and comprises a cylindrical plug 20 of tobacco material comprising glycerine as aerosol former and circumscribed by filter plug wrap 22.

A heat-conducting element 24 consisting of a tube of aluminium foil surrounds and is in direct contact with a rear portion 4*b* of the combustible carbonaceous heat source 40 and an abutting front portion 6*a* of the aerosol-forming substrate 6. As shown in FIG. 3, a rear portion of the aerosol-forming substrate 6 is not surrounded by the heat-conducting element 24.

The airflow directing element 44 is located downstream of the aerosol-forming substrate 6 and comprises an open-ended, substantially air impermeable truncated hollow cone 46 made of, for example, cardboard. The downstream end of the open-ended truncated hollow cone 46 is of substantially the same diameter as the aerosol-forming substrate 6 and the upstream end of the open-ended truncated hollow cone 46 is of reduced diameter compared to the aerosol-forming substrate 6.

The upstream end of the open-ended truncated hollow cone 46 abuts the aerosol-forming substrate 6 and is embedded in an air permeable cylindrical plug 48 of cellulose acetate tow circumscribed by filter plug wrap 50, which is of substantially the same diameter as the aerosol-forming substrate 6. It will be appreciated that in alternative embodiments (not shown), the upstream end of the open-ended truncated hollow cone 46 may extend into the rear portion of the aerosol-forming substrate 6. It will also be appreciated that in alternative embodiments (not shown) the cylindrical plug 48 of cellulose acetate tow may be omitted.

As shown in FIG. 3, the portion of the open-ended truncated hollow cone 46 that is not embedded in the cylindrical plug 48 of cellulose acetate tow is circumscribed by an inner wrapper 52 of low air permeability made of, for example, cardboard. It will be appreciated that in alternative embodiments (not shown) the inner wrapper 52 may be omitted.

As also shown in FIG. 3, a circumferential arrangement of third air inlets 54 is provided in the outer wrapper 12 and inner wrapper 52 circumscribing the open-ended truncated hollow cone 46 downstream of the cylindrical plug 48 of cellulose acetate tow.

The elongate expansion chamber 8 is located downstream of the airflow directing element 44 and comprises a cylindrical open-ended hollow tube 26 made of, for example, cardboard which is of substantially the same diameter as the aerosol-forming substrate 6. The mouthpiece 10 of the smoking article 42 is located downstream of the expansion chamber 8 and comprises a cylindrical plug 28 of cellulose acetate tow of very low filtration efficiency circumscribed by filter plug wrap 30. The mouthpiece 10 may be circumscribed by tipping paper (not shown).

The smoking article 42 according to the sixth embodiment of the invention comprises an airflow pathway extending between the third air inlets 54 and the mouth end of the smoking article 42. The volume bounded by the exterior of the open-ended truncated hollow cone 46 and the inner wrapper 52 forms a first portion of the airflow pathway between the third air inlets 54 and the aerosol-forming substrate 6 and the volume bounded by the interior of the open-ended truncated hollow cone 46 forms a second portion of the airflow pathway between the aerosol-forming substrate 6 and the expansion chamber 8.

In use, when a user draws on the mouthpiece 10, cool air is drawn into the smoking article 42 according to the sixth embodiment of the invention through the third air inlets 54. The drawn air passes upstream to the aerosol-forming substrate 6 along the first portion of the airflow pathway between the exterior of the open-ended truncated hollow cone 46 and the inner wrapper 52 and through the cylindrical plug 48 of cellulose acetate tow.

The front portion 6*a* of the aerosol-forming substrate 6 is heated by conduction through the abutting rear portion 4*b* of the combustible carbonaceous heat source 40 and the heat-conducting element 24. The heating of the aerosol-forming substrate 6 releases volatile and semi-volatile compounds and glycerine from the plug of tobacco material 20, which are entrained in the drawn air as it flows through the aerosol-forming substrate 6. The drawn air and entrained compounds pass downstream along the second portion of the airflow pathway through the interior of the open-ended truncated hollow cone 46 to the expansion chamber 8, where they cool and condense to form an aerosol that passes through the mouthpiece 10 into the mouth of the user.

The non-combustible, substantially air impermeable, first barrier coating 14 provided on the rear face of the combustible carbonaceous heat source 40 isolates the combustible carbonaceous heat source 40 from the airflow pathway through the smoking article 42 such that, in use, air drawn through the smoking article 42 along the first portion of the airflow pathway and the second portion of the airflow pathway does not directly contact the combustible carbonaceous heat source 40.

Figure 4:
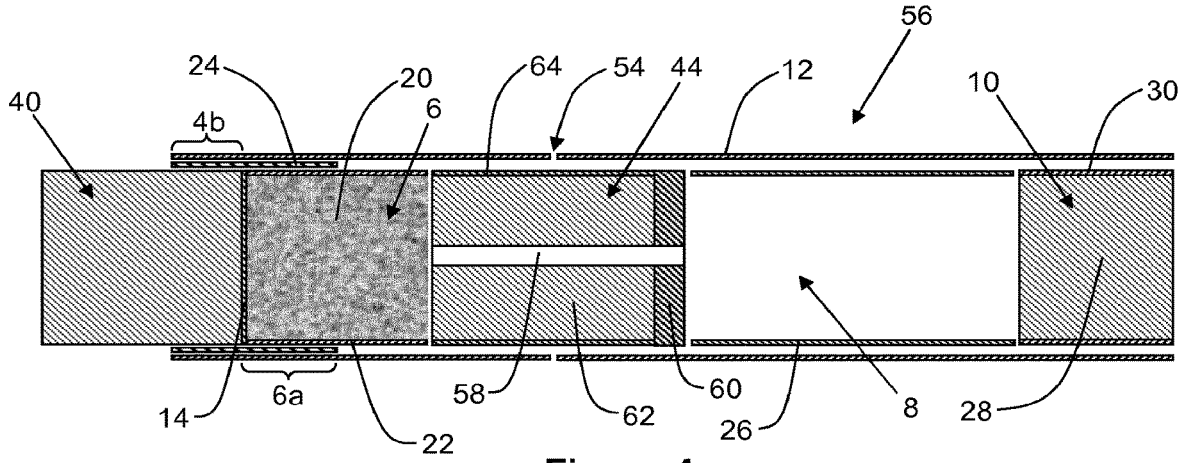
FIG. 4 shows a schematic longitudinal cross-section of a smoking article according to a seventh embodiment of the invention comprising a blind combustible heat source.

The smoking article 56 according to the seventh embodiment of the invention shown in FIG. 4 also comprises a combustible carbonaceous heat source 40, an aerosol-forming substrate 6, an airflow directing element 44, an elongate expansion chamber 8 and a mouthpiece 10 in abutting coaxial alignment. The combustible carbonaceous heat source 40, aerosol-forming substrate 6, airflow directing element 44, elongate expansion chamber 8 and mouthpiece 10 are overwrapped in an outer wrapper of cigarette paper 12 of low air permeability.

As shown in FIG. 4, a non-combustible, substantially air impermeable, first barrier coating 14 is provided on the entire rear face of the combustible carbonaceous heat source 40.

The aerosol-forming substrate 6 is located immediately downstream of the combustible carbonaceous heat source 40 and comprises a cylindrical plug 20 of tobacco material comprising glycerine as aerosol former and circumscribed by filter plug wrap 22.

A heat-conducting element 24 consisting of a tube of aluminium foil surrounds and is in direct contact with a rear portion 4*b* of the combustible carbonaceous heat source 40 and an abutting front portion 6*a* of the aerosol-forming substrate 6. As shown in FIG. 4, a rear portion of the aerosol-forming substrate 6 is not surrounded by the heat-conducting element 24.

The airflow directing element 44 is located downstream of the aerosol-forming substrate 6 and comprises an open-ended, substantially air impermeable hollow tube 58 made of, for example, cardboard, which is of reduced diameter compared to the aerosol-forming substrate 6. The upstream end of the open-ended hollow tube 58 abuts the aerosol-forming substrate 6. The downstream end of the open-ended hollow tube 58 is surrounded by an annular substantially air impermeable seal 60 of substantially the same diameter as the aerosol-forming substrate 6. The remainder of the open-ended hollow tube 58 is embedded in an air permeable cylindrical plug 62 of cellulose acetate tow of substantially the same diameter as the aerosol-forming substrate 6.

The open-ended hollow tube 58 and cylindrical plug 62 of cellulose acetate tow are circumscribed by an air permeable inner wrapper 64

As also shown in FIG. 4, a circumferential arrangement of third air inlets 54 is provided in the outer wrapper 12 circumscribing the inner wrapper 64.

The elongate expansion chamber 8 is located downstream of the airflow directing element 44 and comprises a cylindrical open-ended hollow tube 26 made of, for example, cardboard which is of substantially the same diameter as the aerosol-forming substrate 6. The mouthpiece 10 of the smoking article 56 is located downstream of the expansion chamber 8 and comprises a cylindrical plug 28 of cellulose acetate tow of very low filtration efficiency circumscribed by filter plug wrap 30. The mouthpiece 10 may be circumscribed by tipping paper (not shown).

The smoking article 56 according to the seventh embodiment of the invention comprises an airflow pathway extending between the third air inlets 54 and the mouth end of the smoking article 56. The volume bounded by the exterior of the open-ended hollow tube 58 and the inner wrapper 64 forms a first portion of the airflow pathway between the third air inlets 54 and the aerosol-forming substrate 6 and the volume bounded by the interior of the open-ended hollow tube 58 forms a second portion of the airflow pathway between the aerosol-forming substrate 6 and the expansion chamber 8.

In use, when a user draws on the mouthpiece 10, cool air is drawn into the smoking article 56 according to the seventh embodiment of the invention through the third air inlets 54 and the air permeable inner wrapper 64. The drawn air passes upstream to the aerosol-forming substrate 6 along the first portion of the airflow pathway between the exterior of the open-ended hollow tube 58 and the inner wrapper 64 and through the cylindrical plug 62 of cellulose acetate tow.

The front portion 6*a* of the aerosol-forming substrate 6 is heated by conduction through the abutting rear portion 4*b* of the combustible carbonaceous heat source 40 and the heat-conducting element 24. The heating of the aerosol-forming substrate 6 releases volatile and semi-volatile compounds and glycerine from the plug of tobacco material 20, which are entrained in the drawn air as it flows through the aerosol-forming substrate 6. The drawn air and entrained compounds pass downstream along the second portion of the airflow pathway through the interior of the open-ended hollow tube 58 to the expansion chamber 8, where they cool and condense to form an aerosol that passes through the mouthpiece 10 into the mouth of the user.

The non-combustible, substantially air impermeable, first barrier coating 14 provided on the rear face of the combustible carbonaceous heat source 40 isolates the combustible carbonaceous heat source 40 from the airflow pathway through the smoking article 56 such that, in use, air drawn through the smoking article 56 along the first portion of the airflow pathway and the second portion of the airflow pathway does not directly contact the combustible carbonaceous heat source 40.

Smoking articles according to the sixth and seventh embodiments of the invention shown in FIGS. 3 and 4 having the dimensions shown in Table 2 were assembled using combustible carbonaceous heat sources produced in accordance with Example 1 and 6 below, but without any longitudinal airflow channels.

TABLE 2

| Smoking article | Sixth embodiment | Seventh embodiment |
|---|---|---|
| Overall length (mm) | 84 | 84 |
| Diameter (mm) | 7.8 | 7.8 |
| Porous carbonaceous heat source | | |
| Length (mm) | 8 | 8 |
| Diameter (mm) | 7.8 | 7.8 |
| Thickness of first barrier coating (microns) | 5500 | 5500 |
| Aerosol-forming substrate | | |
| Length (mm) | 10 | 10 |
| Diameter (mm) | 7.8 | 7.8 |

TABLE 2-continued

| Smoking article | Sixth embodiment | Seventh embodiment |
|---|---|---|
| Density (g/cm3) | 0.73 | 0.73 |
| Aerosol former | Glycerine | Glycerine |
| Amount of aerosol former | 20% by dry wt. of tobacco | 20% by dry wt. of tobacco |
| Airflow directing element | | |
| Length (mm) | 18 | 26 |
| Diameter (mm) | 7.8 | 7.8 |
| Length of plug of porous material (mm) | 5 | 24 |
| Diameter of hollow tube (mm) | — | 3.5 |
| Number of air inlets | 4 | 4-8 |
| Diameter of air inlets (mm) | 0.2 | 0.2 |
| Distance of air inlets from upstream end (mm) | 27 | 24 |
| Expansion chamber | | |
| Length (mm) | 41 | 33 |
| Diameter (mm) | 7.8 | 7.8 |
| Mouthpiece | | |
| Length (mm) | 7 | 7 |
| Diameter (mm) | 7.8 | 7.8 |
| Heat-conducting element | | |
| Length (mm) | 7 | 8 |
| Diameter (mm) | 7.8 | 7.8 |
| Thickness of aluminium foil (microns) | 20 | 20 |
| Length of rear portion of combustible carbonaceous heat source (mm) | 3 | 4 |
| Length of front portion of aerosol-forming substrate (mm) | 4 | 4 |
| Length of rear portion of aerosol-forming substrate (mm) | 6 | 6 |

Example 1—Preparation of Combustible Heat Source

Combustible cylindrical carbonaceous heat sources for use in smoking articles according to the invention may be prepared as described in WO2009/074870 A2 or any other prior art that is known to persons of ordinary skill in the art. An aqueous slurry, as described in WO2009/074870 A2, is extruded through a die having a central die orifice of circular cross-section to make the combustible heat source. The die orifice has a diameter of 8.7 mm so as to form cylindrical rods, having a length of between about 20 cm and about 22 cm and a diameter of between about 9.1 cm and about 9.2 mm. A single longitudinal airflow channel is formed in the cylindrical rods by a mandrel mounted centrally in the die orifice. The mandrel preferably has a circular cross-section with an outer diameter of approximately 2 mm or approximately 3.5 mm. Alternatively, three airflow channels are formed in the cylindrical rods using three mandrels of circular cross-section with an outer diameter of approximately 2 mm mounted at regular angles in the die orifice. During extrusion of the cylindrical rods, a clay-based coating slurry (made using clay, such as natural green clay) is pumped through a feed passageway extending through the centre of the mandrel or mandrels to form a thin second barrier coating of about 150 microns to about 300 microns on the inner surface of the airflow channel or channels. The cylindrical rods are dried at a temperature of about 20° C. to about 25° C. under about 40% to about 50% relative humidity for between approximately 12 hours to approximately 72 hours and then pyrolysed in a nitrogen atmosphere at about 750° C. for approximately 240 minutes.

After pyrolysis, the cylindrical rods are cut and shaped to a defined diameter using a grinding machine to form individual combustible-carbonaceous heat sources. The rods after cutting and shaping have a length of about 11 mm, a diameter of about 7.8 mm and a dry mass of about 400 mg. The individual combustible carbonaceous heat sources are subsequently dried at about 130° C. for approximately 1 hour.

Example 2—Coating of Combustible Heat Source with Bentonite/Kaolinite

A non-combustible, substantially air impermeable, first barrier coating of bentonite/kaolinite is provided on the rear face of a combustible carbonaceous heat source prepared as described in Example 1 by dipping, brushing or spray coating. Dipping involves inserting the rear face of the combustible carbonaceous heat source into a concentrated bentonite/kaolinite solution. The bentonite/kaolinite solution for dipping contains 3.8% bentonite, 12.5% kaolinite and 83.7% $H_2O$ [m/m]. The rear face of the combustible carbonaceous heat source is dipped into the bentonite/kaolinite solution for about 1 second and the meniscus allowed to disappear as the result of penetration of the solution into the carbon pores at the surface of the rear face of the combustible carbonaceous heat source. Brushing involves dipping a brush into a concentrated bentonite/kaolinite solution and applying the concentrated bentonite/kaolinite solution on the brush to the surface of the rear face of the combustible carbonaceous heat source until covered. The bentonite/kaolinite solution for brushing contains 3.8% bentonite, 12.5% kaolinite and 83.7% $H_2O$ [m/m].

After application of a non-combustible, substantially air impermeable, first barrier coating by dipping or brushing, the combustible carbonaceous heat source is dried in an oven at about 130° C. for approximately 30 minutes and placed in a desiccator under about 5% relative humidity overnight.

Spray-coating involves a suspension solution, preferably containing 3.6% bentonite, 18.0% kaolinite and 78.4% $H_2O$ [m/m] and having a viscosity of around 50 mPa·s at a shear rate of about 100 $s^{-1}$ as measured with a rheometer (Physica MCR 300, coaxial cylinder arrangement). Spray-coating is done with a Sata MiniJet 3000 spray gun using spray nozzles of 0.5 mm, 0.8 mm or 1 mm on a SMC E-MY2B linear actuator at a velocity of about 10 mm/s to about 100 mm/s. The following spray parameters are used: distance sample-pistol 15 cm; sample velocity 10 mm/s; spray nozzle 0.5 mm; spray jet flat and spray pressure 2.5 bar. In a single spray-coating event, a coating thickness of about 11 microns is typically obtained. Spraying is repeated three times. Between each spray-coating, the combustible carbonaceous heat source is dried at room temperature for about 10 minutes. After application of the non-combustible, substantially air impermeable, first barrier coating, the combustible carbonaceous heat source is pyrolysed at about 700° C. for approximately 1 hour.

Example 3—Coating of Combustible Heat Source with Sintered Glass

A non-combustible, substantially air impermeable, first barrier coating of glass is provided on the rear face of a combustible carbonaceous heat-source prepared as described in Example 1 by spray-coating. Spray-coating with glass is performed with a suspension of ground glass using a fine powder. For example, a spray-coating suspension containing either 37.5% glass powder (3 μm), 2.5% methylcellulose and 60% water with a viscosity of 120 mPa·s, or 37.5% glass powder (3 μm), 3.0% bentonite powder, and 59.5% water with a viscosity of 60 to 100 mPa·s, is used. Glass powder having the compositions and physical properties corresponding to Glass 1, 2, 3 and 4 in Table 3 may be used.

Spray-coating is done with a Sata MiniJet 3000 spray gun using spray nozzles of 0.5 mm, 0.8 mm or 1 mm on a SMC E-MY2B linear actuator at a velocity of about 10 mm/s to about 100 mm/s. Spraying is preferably repeated several times. After the spraying is completed, the combustible carbonaceous heat source is pyrolysed at about 700° C. for approximately 1 hour.

TABLE 3

Composition of glasses in weight percent, transformation temperature Tg, coefficient of thermal expansion $A_{20\text{-}300}$ and Kl-value calculated from composition

| | Glass 1 | Glass 2 | Glass 3 | Glass 4 |
|---|---|---|---|---|
| $SiO_2$ | 70 | 70 | 65 | 60 |
| $Na_2O$ | 20 | 15 | 20 | 20 |
| $K_2O$ | | | | 5 |
| CaO | 10 | 8 | 10 | 10 |
| MgO | | 4 | 5 | 5 |
| $Al_2O_3$ | | 3 | | |
| Tg (° C.) | 517 | 539 | 512 | 465 |
| $A_{20\text{-}300}$ ($10^{-6}$ $K^{-1}$) | 10.9 | 9.3 | 10.2 | 12.1 |
| Kl-value | 30 | 21 | 35 | 40 |

Example 4—Coating of Combustible Heat Source with Aluminium

A non-combustible, substantially air impermeable, first barrier coating of aluminium is provided on the rear face of a combustible carbonaceous heat-source prepared as described in Example 1 by laser cutting an aluminium barrier from aluminium bobbin bands having a thickness of about 20 microns. The aluminium barrier has a diameter of about 7.8 mm and a single hole having an outer diameter of about 1.8 mm in the centre thereof to match the cross section of the combustible carbonaceous heat source of Example 1. In an alternative embodiment, the aluminium barrier has three holes, which are positioned to be aligned with three airflow channels provided in the combustible carbonaceous heat-source. The aluminium barrier coating is formed by attaching the aluminium barrier to the rear face of the combustible carbonaceous heat source using any suitable adhesive.

Example 5—Methods for Measuring Smoke Compounds

Conditions for Smoking

Conditions for smoking and smoking machine specifications are set out in ISO Standard 3308 (ISO 3308:2000). Atmosphere for conditioning and testing are set out in ISO Standard 3402. Phenols are trapped using Cambridge filter pads. Quantitative determination of carbonyls in aerosols, including formaldehyde, acrolein, acetaldehyde and propionaldehyde, is done by UPLC-MSMS. Quantitative measurement of phenolics such as catechol, hydroquinone and phenol is done by LC-fluorescence. Carbon monoxide in the smoke is trapped using gas sampling bags and measured using a non-dispersive infra-red analyzer as set out in ISO Standard 8454 (ISO 8454:2007).

Smoking Regimes

Cigarettes tested under a Health Canada smoking regime are smoked over 12 puffs with a puff volume of 55 ml, puff duration of 2 seconds and a puff interval of 30 seconds. Cigarettes tested under an intense smoking regime are smoked over 20 puffs with a puff volume of 80 ml, a puff duration of 3.5 seconds and puff interval of 23 seconds.

Example 6—Preparation of Combustible Heat Source with Ignition Aid

A carbonaceous combustible heat source comprising an ignition aid is prepared by mixing 525 g of carbon powder, 225 g of calcium carbonate ($CaCO_3$), 51.75 g of potassium citrate, 84 g of modified cellulose, 276 g of flour, 141.75 g of sugar and 21 g of corn oil with 579 g of deionised water to form an aqueous slurry, essentially as disclosed in WO2009/074870 A2. The aqueous slurry is then be extruded through a die having a central die orifice of circular cross-section with a diameter of about 8.7 mm to form cylindrical rods having a length of between about 20 cm and about 22 cm and a diameter of between about 9.1 mm and about 9.2 mm. A single longitudinal airflow channel is formed in the cylindrical rods by a mandrel mounted centrally in the die orifice. The mandrel has a circular cross-section with an outer diameter of approximately 2 mm or approximately 3.5 mm. Alternatively, three airflow channels are formed in the cylindrical rods using three mandrels of circular cross-section with an outer diameter of approximately 2 mm mounted at regular angles in the die orifice. During extrusion of the cylindrical rods, a green clay-based coating slurry is pumped through a feed passageway extending through the centre of the mandrel to form a thin second barrier coating having a thickness of between about 150 microns and about 300 microns on the inner surface of the single longitudinal airflow channel. The cylindrical rods are dried at between about 20° C. and about 25° C. under about 40% to about 50% relative humidity for between approximately 12 hours and approximately 72 hours and then pyrolysed in a nitrogen atmosphere at about 750° C. for approximately 240 minutes. After pyrolysis, the cylindrical rods are cut and shaped to a defined diameter using a grinding machine to form individual combustible-carbonaceous heat sources having a length of about 11 mm, a diameter of about 7.8 mm, and a dry mass of about 400 mg. The individual combustible carbonaceous heat sources are dried at about 130° C. for approximately 1 hour and then placed in an aqueous solution of nitric acid having a concentration of 38 percent by weight and saturated with potassium nitrate ($KNO_3$). After approximately 5 minutes, the individual combustible carbonaceous heat sources are removed from the solution and dried at about 130° C. for approximately 1 hour. After drying the individual combustible carbonaceous heat sources are placed once again in an aqueous solution of nitric acid having a concentration of 38 percent by weight and saturated with potassium nitrate ($KNO_3$). After approximately 5 minutes, the individual combustible carbonaceous heat sources are removed from the solution and dried at about 130° C. for approximately 1 hour, followed by drying at about 160° C. for approximately 1 hour and finally drying at about 200° C. for approximately 1 hour.

Example 7—Smoke Compounds from Smoking Articles with Combustible Heat-Sources with a Non-Combustible, Substantially Air Impermeable, First Barrier Coating of Clay or Glass Combustible cylindrical carbonaceous heat sources comprising an ignition aid are prepared as described in Example 6 with a single longitudinal airflow channel having a diameter of 1.85 mm and a bentonite/kaolinite second barrier coating. The combustible cylindrical carbonaceous heat sources are provided with a non-combustible, substantially air impermeable, first barrier coating of clay as described in Example 2. Additionally, combustible cylindrical carbonaceous heat sources comprising an ignition aid as described in Example 6 with a single longitudinal airflow channel having a diameter of 1.85 mm and a glass second barrier coating are provided with a non-combustible, substantially air impermeable, first barrier coating of sintered glass as described in Example 3. In both cases, the length of the combustible cylindrical carbonaceous heat sources is 11 mm. The non-combustible, substantially air impermeable, first barrier coating of clay has a thickness of between about 50 microns and about 100 microns and the non-combustible, substantially air impermeable, first barrier coating of glass has a thickness of about 20 microns, about 50 microns or about 100 microns. Smoking articles according to the first embodiment of the invention shown in FIGS. 1A and 2 having a total length of 70 mm comprising the aforementioned combustible cylindrical carbonaceous heat sources are assembled by hand. The aerosol-forming substrate of the smoking articles is 10 mm in length and comprises approximately 60% by weight flue-cured tobacco, approximately 10% by weight oriental tobacco and approximately 20% by weight sun-cured tobacco. The heat conducting element of the smoking articles is 9 mm in length, of which 4 mm covers the rear portion of the combustible heat source and 5 mm covers the adjacent front portion of the aerosol-forming substrate. Except as noted in the foregoing description in this Example, the properties of the smoking articles conform to those listed in Table 1 above. Smoking articles of the same construction, but without a non-combustible, substantially air impermeable, first barrier coating, are also assembled by hand for comparison.

The resulting smoking articles are smoked as described in Example 5 under a Health Canada smoking regime. Before smoking, the combustible heat sources of the smoking articles are lit using a regular yellow flame lighter. The formaldehyde, acetaldehyde, acrolein and propionaldehyde in the mainstream aerosol of the smoking articles is measured as described in Example 5. The results are summarised in Table 4 below and show that carbonyls, such as acetaldehyde and especially formaldehyde, are significantly reduced in the mainstream aerosols of smoking articles comprising a combustible heat source with a non-combustible, substantially air impermeable, first barrier coating compared to the mainstream aerosols of smoking articles comprising a combustible heat source without a non-combustible, substantially air impermeable, first barrier coating.

TABLE 4

Amount of carbonyls (micrograms per sample) measured in mainstream aerosol under Health Canada smoking regime for smoking articles comprising a combustible carbonaceous heat source (a) without a non-combustible, substantially air impermeable, first barrier coating, (b) with a non-combustible, substantially air impermeable, first barrier coating of clay and (c) with a non-combustible, substantially air impermeable, first barrier coating of sintered glass.

| Non-combustible, substantially air impermeable, first barrier coating | (a) None | (b) Clay | | (c) Glass | | |
|---|---|---|---|---|---|---|
| Thickness (microns) | | 50 | 100 | 20 | 50 | 100 |
| formaldehyde | 22.19 | 18.2 | 17.6 | 14.87 | 12.99 | 14.56 |
| acetaldehyde | 102.83 | 103.9 | 89.4 | 75.11 | 69.56 | 86.89 |
| acrolein | 7.09 | 7.7 | 7.1 | 6.22 | 4.29 | 5.41 |
| propionaldehyde | 5.09 | 4.9 | 7.7 | 4.50 | 3.64 | 4.78 |

Example 8—Smoke Compounds of Smoking Articles with Combustible Heat-Sources with a Non-Combustible, Substantially Air Impermeable, First Barrier Coating of Aluminium Combustible cylindrical carbonaceous heat sources prepared as described in Example 7 (but not treated with nitric acid) having a length of 11 mm, a single longitudinal airflow channel having a diameter of 1.85 mm and a second barrier coating of micaceous iron oxide coating (Miox, Kärntner Montanindustrie, Wolfsberg, Austria) are provided with a non-combustible, substantially air impermeable, first barrier coating of aluminium having a thickness of about 20 microns as described in Example 4. Smoking articles according to the first embodiment of the invention shown in FIGS. 1A and 2 having a total length of 70 mm comprising the aforementioned combustible cylindrical carbonaceous heat source are assembled by hand. The aerosol-forming substrate of the smoking articles is 10 mm in length and contains approximately 60% by weight flue-cured tobacco, approximately 10% by weight oriental tobacco and approximately 20% by weight sun-cured tobacco. The heat conducting element of the smoking articles is 9 mm in length, of which 4 mm covers the rear portion of the combustible heat source and 5 mm covers the adjacent front portion of the aerosol-forming substrate. Except as noted in the foregoing description within this Example, the properties of the smoking articles conform to those listed in Table 1 above. Smoking articles of the same construction, but without a non-combustible, substantially air impermeable, first barrier coating, are also assembled by hand for comparison.

The smoking articles are smoked as described in Example 5, under a Health Canada smoking regime and an intense smoking regime. Before smoking, the combustible heat sources are lit using a regular yellow flame lighter. The formaldehyde, acetaldehyde, acrolein, propionaldehyde, phenol, catechol and hydroquinone in the mainstream aerosol of the smoking articles are measured as described in Example 5. The results are summarized in Table 5. As can be seen from Table 4, under both the Health Canada and intense smoking regimes, the inclusion of a non-combustible, substantially air impermeable, first barrier coating of aluminium on the rear face of the combustible heat source leads to a significant reduction of phenolics and carbonyls such as formaldehyde and acetaldehyde in the mainstream aerosol.

TABLE 5

| | (i) Health Canada smoking regime | | (ii) Intense smoking regime | |
|---|---|---|---|---|
| Non-combustible, substantially air impermeable, first barrier coating | (a) None | (b) Aluminium | (a) None | (b) Aluminium |
| formaldehyde | 21.2 | 11.6 | 30.4 | 17.8 |
| acetaldehyde | 26.6 | 20.9 | 63.7 | 54.0 |
| Acrolein | 2.88 | 1.53 | 4.97 | 4.58 |
| propionaldehyde | 1.46 | 0.88 | 3.51 | 2.41 |
| Phenol | 0.33 | 0.20 | not measured | not measured |
| catechol | 2.50 | 1.58 | not measured | not measured |
| hydroquinone | <1.05 | <1.05 | not measured | not measured |

Amount of compounds (micrograms per sample) measured in mainstream aerosol under
(i) Health Canada smoking regime and
(ii) intense smoking regime for smoking articles comprising a combustible carbonaceous heat source
(a) without a non-combustible, substantially air impermeable, first barrier coating and
(b) with a non-combustible, substantially air impermeable, first barrier coating of aluminium.

As can be seen from Examples 7 and 8, isolating the combustible heat source of smoking articles according to the invention from the one or more airflow pathways through the smoking article by providing a non-combustible, substantially air impermeable, first barrier coating on at least substantially the entire rear face of the combustible heat source and a non-combustible, substantially air impermeable, second barrier coating on at least substantially the entire inner surface of the airflow channel through the combustible heat source results in significantly reduced formation of carbonyl compounds, such as formaldehyde, acetaldehyde, propionaldehyde and phenolics, in the mainstream aerosol.

The embodiments and examples described above illustrate but do not limit the invention. Other embodiments of the invention may be made without departing from the spirit and scope thereof, and it is to be understood that the specific embodiments described herein are not limiting.

The invention claimed is:

1. A smoking article, comprising:

a combustible heat source having a front end and a rear end;

an aerosol-forming substrate downstream of the rear end of the combustible heat source;

an outer wrapper circumscribing the aerosol-forming substrate and at least a rear portion of the combustible heat source;

one or more airflow pathways along which air may be drawn through the smoking article for inhalation;

one or more third air inlets downstream of the aerosol-forming substrate for drawing air into the one or more airflow pathways; and an airflow directing element downstream of the aerosol-forming substrate, wherein the one or more third air inlets are provided between a downstream end of the aerosol-forming substrate and a downstream end of the airflow directing element, wherein the one or more airflow pathways comprise an airflow pathway extending between the one or more third air inlets and a mouth end of the smoking article, wherein the combustible heat source is isolated from the one or more airflow pathways such that air drawn through the smoking article along the one or more airflow pathways does not directly contact the combustible heat source, and wherein the airflow directing element overlaps with the one or more third air inlets.

2. The smoking article according to claim 1, further comprising a non-combustible, substantially air impermeable, first barrier between a downstream end of the combustible heat source and an upstream end of the aerosol-forming substrate.

3. The smoking article according to claim 2, wherein the first barrier comprises a first barrier coating provided on the rear face of the combustible heat source.

4. The smoking article according to claim 3, wherein the first barrier coating is applied to the rear face of the combustible heat source by vapour deposition.

5. The smoking article according to claim 1, wherein the one or more airflow pathways comprise one or more airflow channels along the combustible heat source.

6. The smoking article according to claim 5, further comprising a non-combustible, substantially air impermeable, second barrier between the combustible heat source and the one or more airflow channels.

7. The smoking article according to claim 6, wherein the second barrier comprises a second barrier coating provided on an inner surface of the one or more airflow channels.

8. The smoking article according to claim 1, further comprising one or more first air inlets between a downstream end of the combustible heat source and an upstream end of the aerosol-forming substrate.

9. The smoking article according to claim 1, further comprising one or more second air inlets about the periphery of the aerosol-forming substrate for drawing air into the one or more airflow pathways.

10. The smoking article according to claim 1, wherein the airflow pathway extending between the one or more third air inlets and the mouth end of the smoking article comprises a first portion extending from the one or more third air inlets to the aerosol-forming substrate and a second portion extending from the aerosol-forming substrate to the mouth end of the smoking article.

11. The smoking article according to claim 1, further comprising:

a heat-conducting element around and in direct contact with a rear portion of the combustible heat source and a front portion of the aerosol-forming substrate.

12. The smoking article according to claim 11, wherein the heat-conducting element includes a steel wrapper.

13. The smoking article according to claim 1, further comprising:

an expansion chamber downstream of the aerosol-forming substrate.

14. The smoking article according to claim 1, wherein the airflow directing element extends a distance of up to 0.5L into the aerosol-forming substrate, where L is the length of the aerosol-forming substrate.

15. The smoking article according to claim 1, further comprising:

a mouthpiece downstream of the aerosol-forming substrate and downstream of the airflow directing element.

16. The smoking article according to claim 15, wherein the airflow directing element is disposed closer to the aerosol-forming substrate than the mouthpiece.

17. The smoking article according to claim 1, wherein the airflow directing element is adjacent to the aerosol-forming substrate.

18. The smoking article according to claim 13, wherein the airflow directing element is disposed upstream of the expansion chamber.

19. The smoking article according to claim 13, wherein the airflow directing element is disposed between the aerosol-forming substrate and the expansion chamber.

20. The smoking article according to claim 10, wherein the first portion overlaps with the airflow directing element.

21. The smoking article according to claim 1, wherein the airflow directing element is substantially air impermeable and hollow.

* * * * *